US012758076B2

(12) United States Patent
Yang et al.

(10) Patent No.: US 12,758,076 B2
(45) Date of Patent: Oct. 13, 2026

(54) SCRAPER

(71) Applicant: Maya Technologies Limited, Hong Kong (CN)

(72) Inventors: Shanglin Yang, Hong Kong (CN); Jinming Zhang, Hong Kong (CN)

(73) Assignee: Maya Technologies Limited, Hong Kong (CN)

( * ) Notice: Subject to any disclaimer, the term of this patent is extended or adjusted under 35 U.S.C. 154(b) by 0 days.

(21) Appl. No.: 19/345,074

(22) Filed: Sep. 30, 2025

(65) Prior Publication Data

US 2026/0240397 A1 Aug. 20, 2026

Related U.S. Application Data

(63) Continuation-in-part of application No. 19/190,853, filed on Apr. 28, 2025, now Pat. No. 12,472,650, and a continuation-in-part of application No. 19/189,307, filed on Apr. 25, 2025, now Pat. No. 12,458,193, said application No. 19/190,853 is a continuation-in-part of application No. 29/989,717, filed on Feb. 14, 2025, now Pat. No. Des. 1,096,038, said application No. 19/189,307 is a continuation-in-part of application No. 29/989,709, filed on Feb. 14, 2025, said application No. 19/190,853 is a continuation-in-part (Continued)

(30) Foreign Application Priority Data

Apr. 1, 2025 (CN) ..... 202520601410.5
Apr. 1, 2025 (CN) ..... 202520601429.X
Aug. 4, 2025 (CN) ..... 202521646338.4
Aug. 4, 2025 (CN) ..... 202521646345.4
Aug. 4, 2025 (CN) ..... 202521646351.X

(51) Int. Cl.
*A47L 13/08* (2006.01)
*A47L 13/022* (2006.01)

(52) U.S. Cl.
CPC ..... *A47L 13/022* (2013.01); *A47L 13/08* (2013.01)

(58) Field of Classification Search
None
See application file for complete search history.

(56) References Cited

U.S. PATENT DOCUMENTS 4,558,517 A * 12/1985 Gringer ..... B44D 3/164 30/162
4,955,138 A * 9/1990 Henke ..... A47L 13/08 30/169

(Continued)

*Primary Examiner* — Hwei-Siu C Payer
(74) *Attorney, Agent, or Firm* — AVEK IP, LLC

(57) ABSTRACT

A scraper includes a housing and a connection body. The housing defines a mounting cavity with an opening and a guiding hole communicated with the mounting cavity. The connecting member is slidably mounted in the mounting cavity and includes a connection body, a button portion, and a clamping portion. The button portion is connected to the connection body and at least partially arranged in the guiding hole. The button portion is configured to be pushed to enable the connection body to slide in the mounting cavity. The clamping portion is connected to an end of the connection body and configured to fasten a working blade. The working blade is configured to at least partially extend out of the mounting cavity or to be retracted in the mounting cavity through the opening.

18 Claims, 15 Drawing Sheets

Related U.S. Application Data of application No. 29/989,709, filed on Feb. 14, 2025, said application No. 19/189,307 is a continuation-in-part of application No. 29/989,717, filed on Feb. 14, 2025, now Pat. No. Des. 1,096,038.

(56) References Cited

U.S. PATENT DOCUMENTS

| | | | | |
|---|---|---|---|---|
| 5,433,004 | A * | 7/1995 | Thompson | A47L 13/08 30/169 |
| 12,458,193 | B1 * | 11/2025 | Yang | A47L 13/08 |
| 12,472,650 | B1 * | 11/2025 | Yang | B26B 5/003 |
| 2005/0120564 | A1 * | 6/2005 | Chen Lin | A47L 13/08 30/169 |
| 2009/0199411 | A1 * | 8/2009 | van Deursen | A47L 13/08 30/169 |

* cited by examiner

SCRAPER

CROSS REFERENCE TO RELATED APPLICATIONS

This application is a continuation-in-part of the U.S. patent application Ser. No. 19/190,853, filed on Apr. 28, 2025, now U.S. Pat. No. 12,472,650, and a continuation-in-part of the U.S. patent application Ser. No. 19/189,307, filed on Apr. 25, 2025, now U.S. Pat. No. 12,458,193. This application claims foreign priorities of the Chinese patent application No. 202520601410.5, filed on Apr. 1, 2025, the Chinese patent application No. 202520601429.X, filed on Apr. 1, 2025, the Chinese patent application No. 202521646338.4, filed on Aug. 4, 2025, the Chinese patent application No. 202521646345.4, filed on Aug. 4, 2025, and the Chinese patent application No. 202521646351.X, filed on Aug. 4, 2025. The disclosure of which is hereby incorporated by reference in their entireties.

The U.S. application Ser. No. 19/190,853 is a continuation-in-part of the U.S. application Ser. No. 29/989,717, filed on Feb. 14, 2025, now U.S. Patent No. D1096038, and a continuation-in-part of the U.S. application Ser. No. 29/989,709, filed on Feb. 14, 2025, now U.S. Patent No. D1126817.

The U.S. application Ser. No. 19/189,307 is a continuation-in-part of the U.S. application Ser. No. 29/989,717, filed on Feb. 14, 2025, now U.S. Patent No. D1096038, and a continuation-in-part of the U.S. application Ser. No. 29/989,709, filed on Feb. 14, 2025, now U.S. Patent No. D1126817.

FIELD OF THE DISCLOSURE

The present disclosure relates to the field of cleaning tools, and in particular, to a scraper.

BACKGROUND

A cleaning scraper includes a housing and a connection plate slidably mounted in the housing. Existing scrapers usually additionally have a button and a mounting plate for fastening a blade on the connection plate, resulting in a need to produce multiple parts for assembly, which increases production costs.

SUMMARY

The present disclosure provides a scraper. The scraper includes a housing and a connection body. The housing defines a mounting cavity with an opening and a guiding hole communicated with the mounting cavity. The connecting member is slidably mounted in the mounting cavity and includes a connection body, a button portion, and a clamping portion. The button portion is connected to the connection body and at least partially arranged in the guiding hole. The button portion is configured to be pushed to enable the connection body to slide in the mounting cavity. The clamping portion is connected to an end of the connection body and configured to fasten a working blade. The working blade is configured to at least partially extend out of the mounting cavity or to be retracted in the mounting cavity through the opening.

BRIEF DESCRIPTION OF THE DRAWINGS

Illustrative embodiments of the present disclosure are described in detail below with reference to the attached drawing figures.

REFERENCE NUMERALS IN THE DRAWINGS

Figure 1:
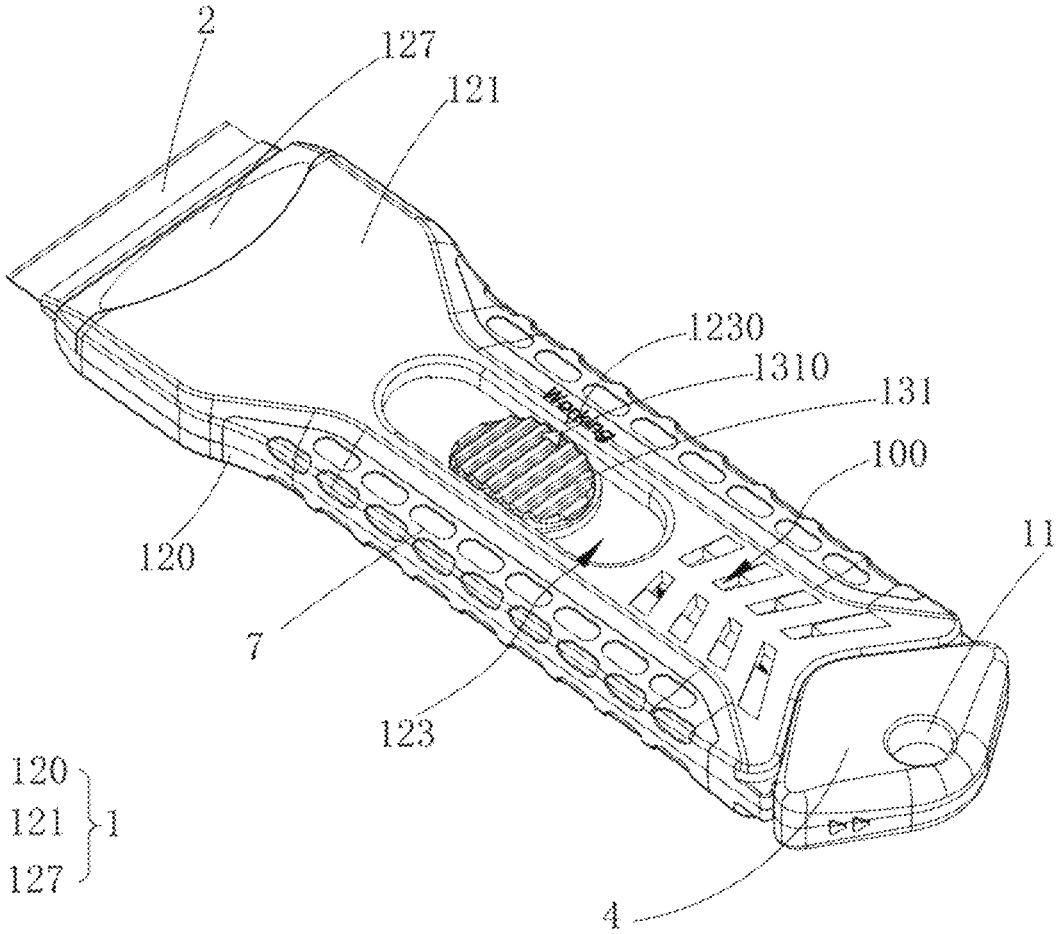
FIG. 1 is a first schematic view of an overall structure of a scraper according to some embodiments of the present disclosure.

1—housing; 10*a*—receiving cavity; 100—viewing window; 101—access opening; 102—operation notch; 103—engagement recess; 11—hanging through hole; 12*a*—mounting cavity; 12*a*1—first inner wall of the mounting cavity; 12*a*2—second inner wall of the mounting cavity; 12*b*—shaft reinforcement portion; 120—bottom shell; 1200—fastening positioning protrusion; 1201—first hook recess; 1202—locking hook recess; 121—top shell; 1210—fastening positioning recess; 1211—first engagement hook; 1212—locking engagement hook; 1213—mounting through hole; 1214—front end wall of the top shell; 122—opening; 123—guiding hole; 1230—working state indicator; 124—limiting recess; 1240—guiding wall; 1241—first limiting wall; 125—locking portion; 125*a*—locking groove; 1250—second limiting wall; 1251—third limiting wall; 1252—bottom wall; 127—connecting bridge; 1270—limiting end wall; 128—limiting platform;

13—connecting member; 130—clamping portion; 13*a*—clamping gap; 13*a*1—exposure opening; 13*a*2—clamping section; 13*a*3—guiding section; 13*a*4—first recess; 13*a*5—second recess; 1300—clamping base plate; 1301—clamping cover plate; 1302—first clamping face; 1303—first connection end; 1304—second clamping face; 1305—second connection end; 1306—locking hole; 1307—locking protrusion; 1308—limiting protrusion; 1309—limiting groove; 131—button portion; 1310—indicator arrow; 132—connection body; 133—elastic support portion; 1330—support leg; 1331—connection end; 1332—contact end; 134—cooperating portion; 134*a*—limiting boss;

15—shaft rod; 150—positioning shaft; 151—insertion rod portion;

2—working blade; 20—blade body; 21—blade edge; 22—edged portion; 3—spare blade;

4—cover; 40—hinge portion; 400—connection arm; 401—connection through hole; 41—engagement portion; 42—protruding portion; 420—receiving groove; 421—guiding strip;

5—magnetic member;

7—soft rubber sleeve;

M—cleaning face;

F—reaction force; F'—reaction force; F1—first component force; F1'—first component force; F2—elastic preload force; F2'—elastic preload force;

D1—thickness of the guiding section; D2—thickness of the clamping section; D3—thickness of the edged portion; D4—thickness of the blade body.

DETAILED DESCRIPTION

The following describes some non-limiting exemplary embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

Unless otherwise defined, all technical and scientific terms used herein have the same meanings as commonly understood by those skilled in the technical field of the disclosure. The terms used in the specification of the disclosure are for describing specific embodiments only and are not intended to limit the disclosure. The terms "comprising" and "having" in the specification and claims of the disclosure, as well as any variations thereof, are intended to cover non-exclusive inclusion. The terms "first," "second," etc., in the specification and claims of the disclosure or the above drawings are used to distinguish different objects and not to describe a specific order.

In this document, reference to "embodiments" means that specific features, structures, or characteristics described in the embodiments may be included in at least one embodiment of the disclosure. The appearance of the phrase in various places in the specification does not necessarily refer to the same embodiment, nor is it an independent or alternative embodiment mutually exclusive with other embodiments. Those skilled in the art explicitly and implicitly understand that the embodiments described herein may be combined with other embodiments.

To enable those skilled in the art to better understand the solutions of the disclosure, the following clearly and completely describes the technical solutions in the embodiments of the disclosure with reference to the accompanying drawings.

Referring to FIGS. 1-15, an embodiment of the present disclosure provides a scraper. The scraper may include a housing 1 and a connecting member 13. The housing 1 may define a mounting cavity 12*a* extending along a length direction of the housing 1. The mounting cavity 12*a* may have an opening 122. The housing 1 may further define a guiding hole 123 communicated with the mounting cavity 12*a*. The guiding hole 123 may extend along the length direction of the housing 1. The connecting member 13 may be slidably mounted in the mounting cavity 12*a*. The connecting member 13 may include a connection body 132, a button portion 131, and a clamping portion 130. The button portion 131 may be connected to the connection body 132. At least a portion of the button portion 131 may be arranged in the guiding hole 123. The connection body 132 may be enabled to slide in the mounting cavity 12*a* through the button portion 131. The clamping portion 130 may be arranged at one end of the connection body 132. The clamping portion 130 may fasten a working blade 2. The working blade 2 may at least partially extend out of the mounting cavity 12*a* or be retracted in the mounting cavity 12*a* through the opening 122.

Specifically, the connection body 132 may be formed using an integral molding process as a one-piece structure. The connection body 132 may serve as a main structure of the connecting member 13. The clamping portion 130 for fastening the working blade 2 may be arranged at a front end of the connection body 132. The button portion 131 and the connection body 132 may be integrally formed as a one-piece structure, and the button portion 131 may be arranged at an end of the connection body 132 away from the clamping portion 130. The button portion 131 may specifically protrude from the connection body 132. A face of the button portion 131 may be arranged with anti-slip patterns to facilitate the user to press and push the connecting member 13 to slide in the mounting cavity 12*a*. To facilitate user control of the button portion 131, the guiding hole 123 formed in the housing 1 may be in a strip-shape, a length direction of the guiding hole 123 may be consistent with a sliding direction of the connecting member 13. When the connecting member 13 is arranged in the mounting cavity 12*a*, the button portion 131 may be arranged in the guiding hole 123. The clamping portion 130 may enter the mounting cavity 12*a* or extend out from the mounting cavity 12*a* through the opening 122. To improve stability of the working blade 2 on the clamping portion 130, the clamping portion 130 may be composed of two elastic clamping plates. The two elastic clamping plates may cooperatively define a clamping gap 13*a*. A height of a portion of the clamping gap 13*a* for receiving a portion of the working blade 2 to be clamped by the two elastic clamping plates may be slightly smaller than a thickness of a main body of the working blade 2, so that the two elastic clamping plates may stably clamp the working blade 2. In summary, by manufacturing various parts of the connecting member 13 in an integrally formed manner, the number of parts required for the scraper may be reduced, and an assembly process of the scraper may be effectively reduced, greatly lowering a production cost of the scraper.

As shown in FIGS. 4, 6, 7, and 12, the housing 1 may include a bottom shell 120 and a top shell 121. The bottom shell 120 and the top shell 121 may be mutually engaged with each other to cooperatively form the mounting cavity 12*a*. The mounting cavity 12*a* may serve as a main chamber in the housing 1, providing mounting and activity space for the connecting member 13 and storage space for the working blade 2. The opening 122 of the mounting cavity 12*a* may be formed on a front end face of the housing 1. The connecting member 13 may slide in the mounting cavity 12*a* and have a retracted position, a working position, and a replacement position. When the connecting member 13 is in the retracted position, the working blade 2 may be completely received in the mounting cavity 12*a*, and the scraper may be in a stored state. When the connecting member 13 is in the working position, the working blade 2 may partially extend out of the mounting cavity 12*a* through the opening 122, and the scraper may be in a working state. When the connecting member 13 is in the replacement position, both the working blade 2 and the clamping portion 130 may at least partially extend out of the mounting cavity 12*a* through the opening 122, and the scraper may be in a blade replaceable state. The user may remove the working blade 2 from the clamping portion 130 and take a spare blade 3 from a receiving cavity 10*a* described later to load the spare blade 3 to the clamping portion 130.

Figure 6:
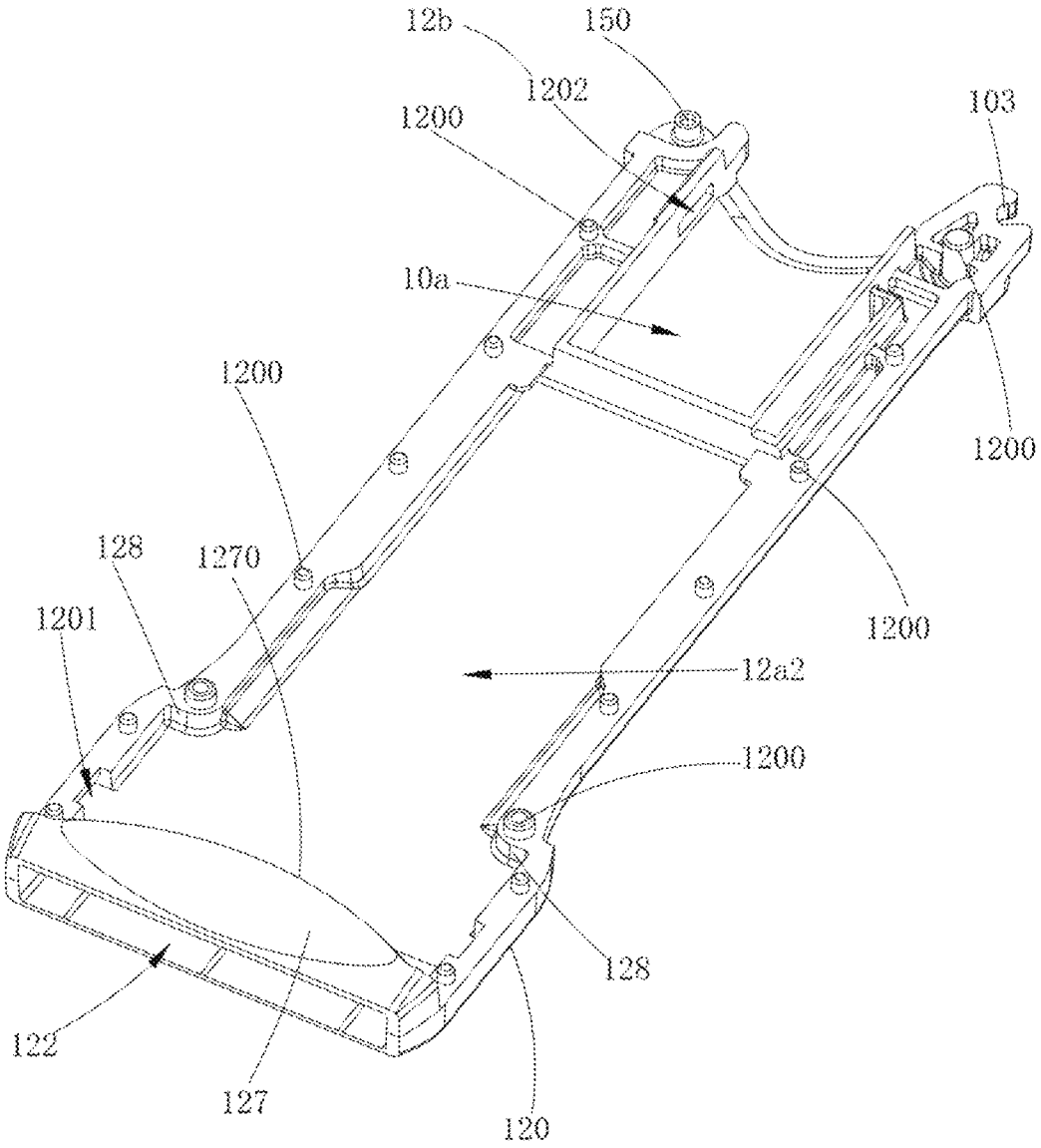
FIG. 6 is a structural view of a bottom shell according to some embodiments of the present disclosure.
Figure 7:
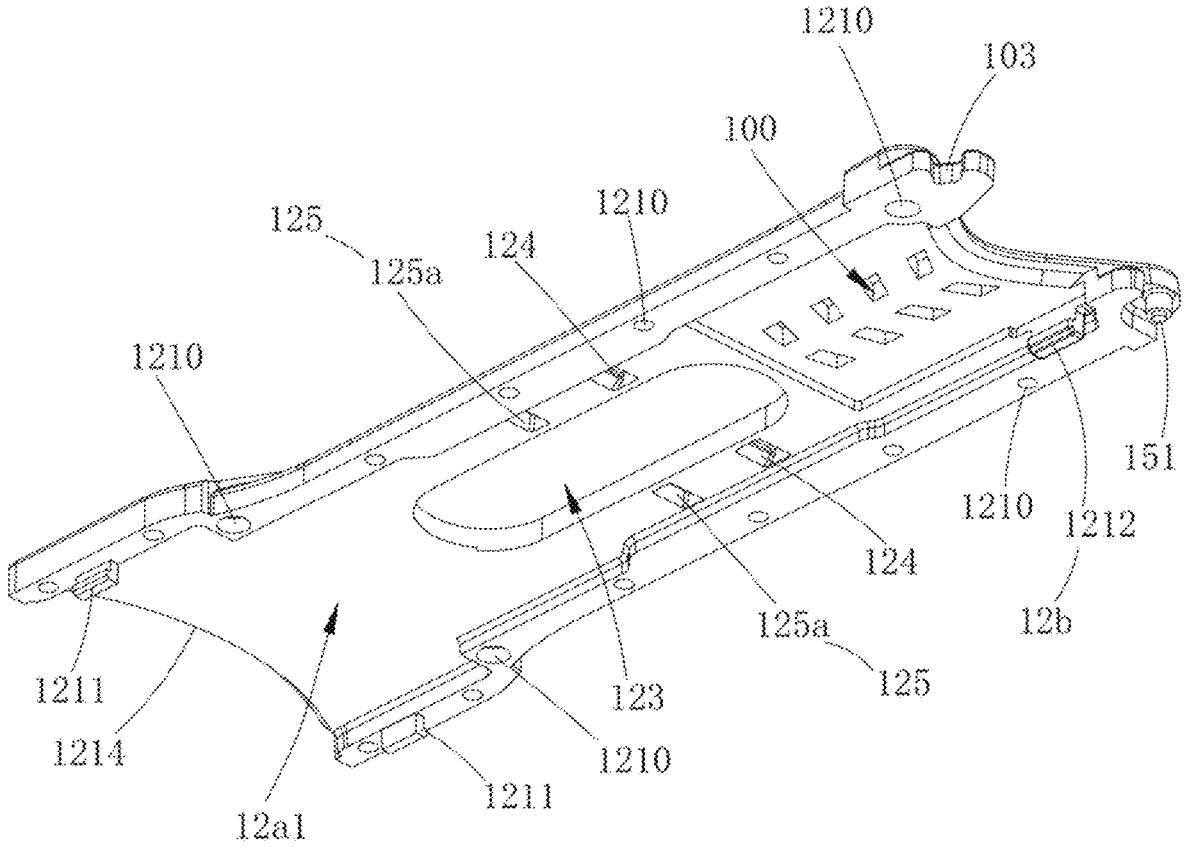
FIG. 7 is a structural view of a top shell according to some embodiments of the present disclosure.

Referring to FIGS. 6 and 7, the housing 1 may include a first inner wall 12*a*1 and a second inner wall 12*a*2 that may cooperatively define the mounting cavity 12*a* and may be arranged opposite each other. The first inner wall 12*a*1 may be formed by the top shell 121, the second inner wall 12*a*2 may be formed by the bottom shell 120, and the connecting member 13 may be located between the first inner wall 12*a*1 and the second inner wall 12*a*2. Correspondingly, the guiding hole 123 may be formed in the top shell 121. When the connecting member 13 is mounted in the mounting cavity 12*a*, the button portion 131 may protrude toward the first inner wall 12*a*1 and may be partially arranged in the guiding hole 123. A side of the connection body 132 away from the button portion 131 may face the second inner wall 12*a*2. When the connecting member 13 is in the retracted position and the working position, a thickness of the clamping portion 130 may be approximately the same as a distance between the first inner wall 12*a*1 and the second inner wall 12*a*2, thereby improving sliding stability of the connecting member 13 in the mounting cavity 12*a*. Furthermore, an outer contour of the connection body 132 may be approximately the same as an inner contour of the mounting cavity 12*a*, improving the sliding stability of the connection body 132 in the mounting cavity 12*a*. It should also be noted that an outer face of the housing 1 may also be arranged with a working state indicator 1230. The working state indicator 1230 may be formed beside the guiding hole 123. A face of the button portion 131 may be arranged with an indicator arrow 1310. The indicator arrow 1310 pointing to the working state indicator 1230 may indicate that the connecting member 13 may have been pushed to the designated working position and the scraper is in the working state.

Figure 10:
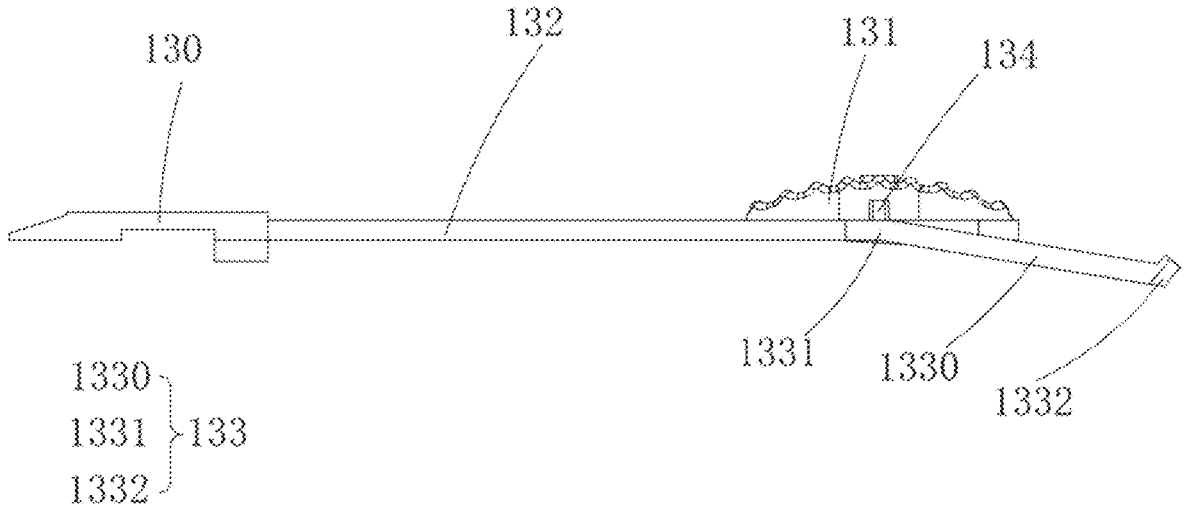
FIG. 10 is a second structural view of the connecting member according to some embodiments of the present disclosure, showing a support leg inclined away from the clamping portion.

Referring to FIGS. 4, 7, 8, 10, 11, 12, and 3, in some embodiments, the connecting member 13 may further include an elastic support portion 133 and a cooperating portion 134. The elastic support portion 133 and the connection body 132 may be integrally formed as a one-piece structure. Each of the elastic support portion 133 and the button portion 131 may be arranged on a respective one of two opposite sides of the connection body 132 (as shown in FIG. 10). Support may be formed by the elastic support portion 133 abutting against an inner side of the housing 1, placing the button portion 131 in the guiding hole 123. That is, the elastic support portion 133 may contact the second inner wall 12*a*2 of the bottom shell 120 to form support, and the button portion 131 may extend to the guiding hole 123 of the top shell 121. The cooperating portion 134 and the connection body 132 may be integrally formed as a one-piece structure, and the cooperating portion 134 may be arranged close to the button portion 131. An inner side of the housing 1 may be arranged with a locking portion 125 that may be engaged with the cooperating portion 134. An elastic force of the elastic support portion 133 may drive the locking portion 125 to be engaged with the cooperating portion 134. Pressing the button portion 131 may enable the locking portion 125 to be disengaged from the cooperating portion 134. When the working blade 2 extends out of the mounting cavity 12*a* and is in the working position, the locking portion 125 may be engaged with the cooperating portion 134 to restrict a relative position between the connection body 132 and the housing 1. The locking portion 125 may include a locking groove 125*a*. The cooperating portion 134 may include a limiting boss 134*a*. The limiting boss 134*a* may be engageable in the locking groove 125*a*. The housing 1 may further define a limiting recess 124, and the limiting boss 134*a* may be engageable in the limiting recess 124. The limiting recess 124 may be formed in an inner wall of the housing 1. The limiting recess 124 and the locking groove 125*a* may be distributed at intervals along a sliding direction of the connection body 132. The elastic force of the elastic support portion 133 may drive the limiting boss 134*a* to be engaged in the limiting recess 124 or the locking groove 125*a*. Pressing the button portion 131 may enable the limiting boss 134*a* to be disengaged from the limiting recess 124 or the locking groove 125*a*.

Figure 13:
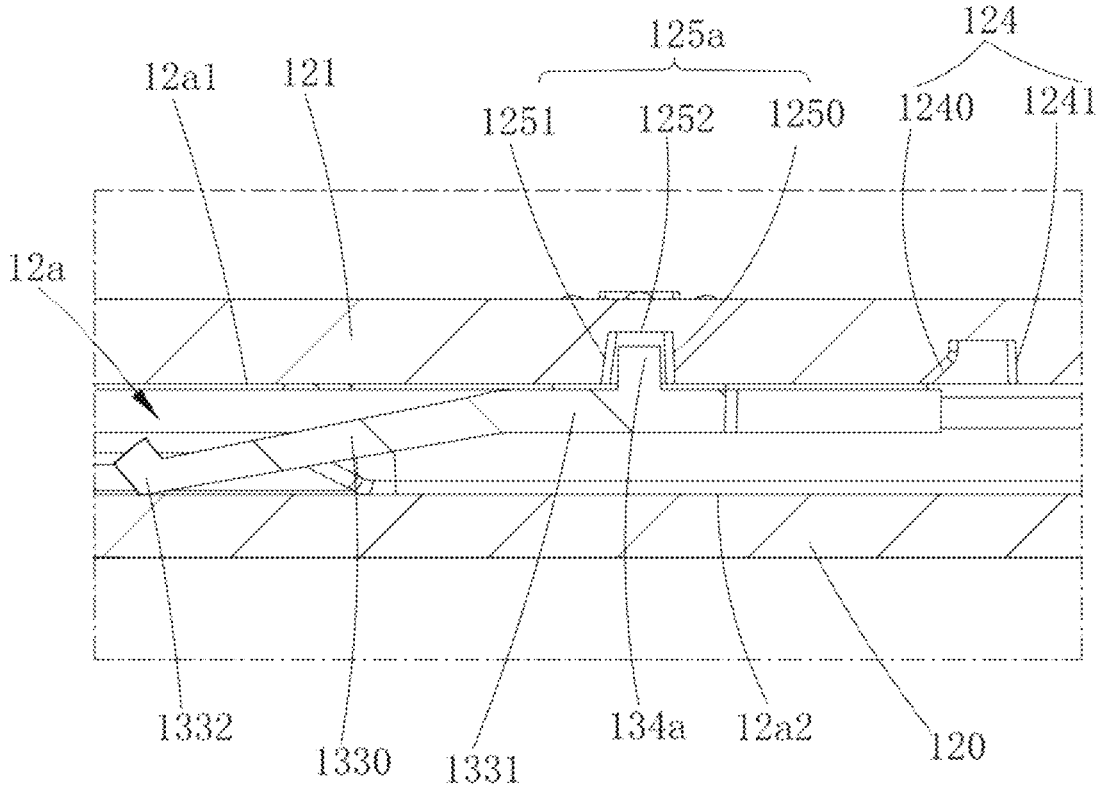
FIG. 13 is an enlarged view of a portion A in FIG. 12.

Referring to FIG. 13, specifically, the limiting recess 124 and the locking groove 125*a* may be formed in the first inner wall 12*a*1 of the mounting cavity 12*a*. The limiting recess 124 and the locking groove 125*a* may be distributed at intervals along the sliding direction of the connecting member 13. The elastic support portion 133 may form elastic support for the connection body 132 by abutting against the second inner wall 12*a*2 of the mounting cavity 12*a*. The elastic force of the elastic support portion 133 may drive the limiting boss 134*a* to be engaged in the limiting recess 124 or the locking groove 125*a*. Pressing the button portion 131 may enable the limiting boss 134*a* to be disengaged from the limiting recess 124 or the locking groove 125*a*.

Figure 11:
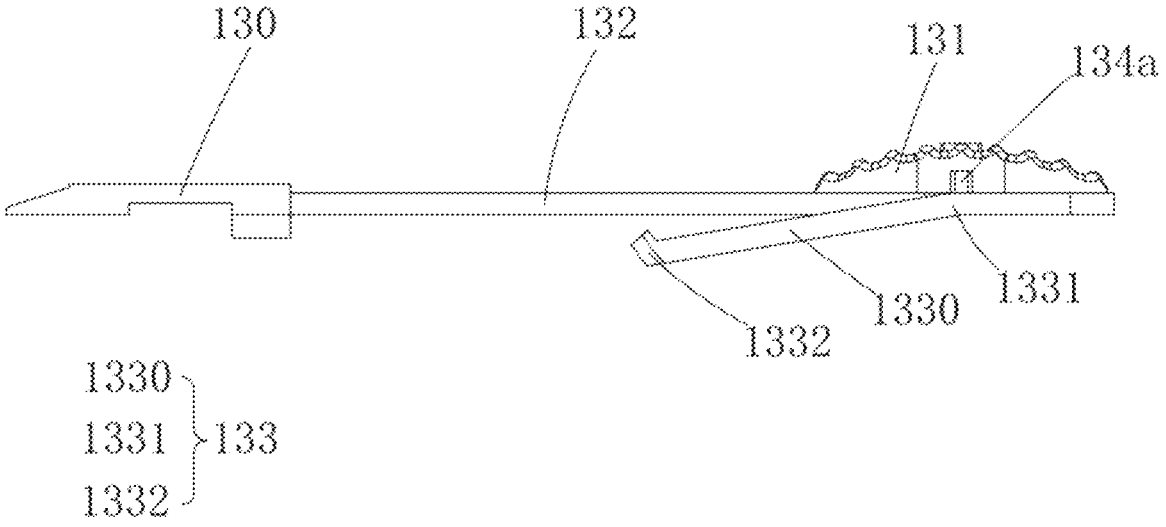
FIG. 11 is a third structural view of the connecting member according to some embodiments of the present disclosure, showing the support leg inclined towards the clamping portion.

Since the mounting cavity 12*a* is formed by an engagement of the bottom shell 120 and the top shell 121, the guiding hole 123, the limiting recess 124, and the locking groove 125*a* may be specifically formed in the top shell 121. The elastic support portion 133 may specifically realize the support for the connection body 132 by contacting the bottom shell 120. The elastic support portion 133 may be specifically implemented as a support leg 1330 as shown in FIG. 10 or FIG. 11. The support leg 1330 may extend from the connection body 132 and may be obliquely arranged relative to the connection body 132. The oblique arrangement of the support leg 1330 may naturally form a support for the connection body 132, causing the connection body 132 to be in a cantilevered state and having an elastic effect. In other embodiments, the elastic support portion 133 may also be implemented as structural members with elastic reset such as a spring or elastic rubber.

When the button portion 131 is pressed, the connection body 132 may move closer to the bottom shell 120 and compress the elastic support portion 133, causing the limiting boss 134*a* to be disengaged from the limiting recess 124 or the locking groove 125*a*. Pushing the button portion 131 then may allow the connection body 132 to slide. When the pressing force on the button portion 131 is released, the limiting boss 134*a* may be re-engaged in the limiting recess 124 or the locking groove 125*a* under the elastic force of the elastic support portion 133, keeping the connection body 132 a designated position.

A distance between the limiting recess 124 and the locking groove 125*a* may be arranged to match a sliding stroke of the connecting member 13 from the retracted position to the working position, the limiting recess 124 may be located away from the opening 122, and the locking groove 125*a* may be located close to the opening 122. Specifically, when the connecting member 13 is in the retracted position, the limiting boss 134*a* may be engaged in the limiting recess 124; when the connecting member 13 is in the working position, the limiting boss 134*a* may be engaged in the locking groove 125*a*. To improve stability of the connecting member 13, two limiting recesses 124 and two locking grooves 125*a* may be formed. The two limiting recesses 124 may be symmetrically distributed on both sides of the guiding hole 123, and the two locking grooves 125*a* may be symmetrically distributed on both sides of the guiding hole 123. Correspondingly, two limiting bosses 134*a* may be formed and symmetrically arranged on both sides of the button portion 131 and close to the button portion 131, ensuring that pressing the button portion 131 may cause the limiting bosses 134*a* to move along a pressing direction of the button portion 131, facilitating disengagement of the limiting bosses 134*a* from the limiting recesses 124 or the locking grooves 125*a*.

Figure 12:
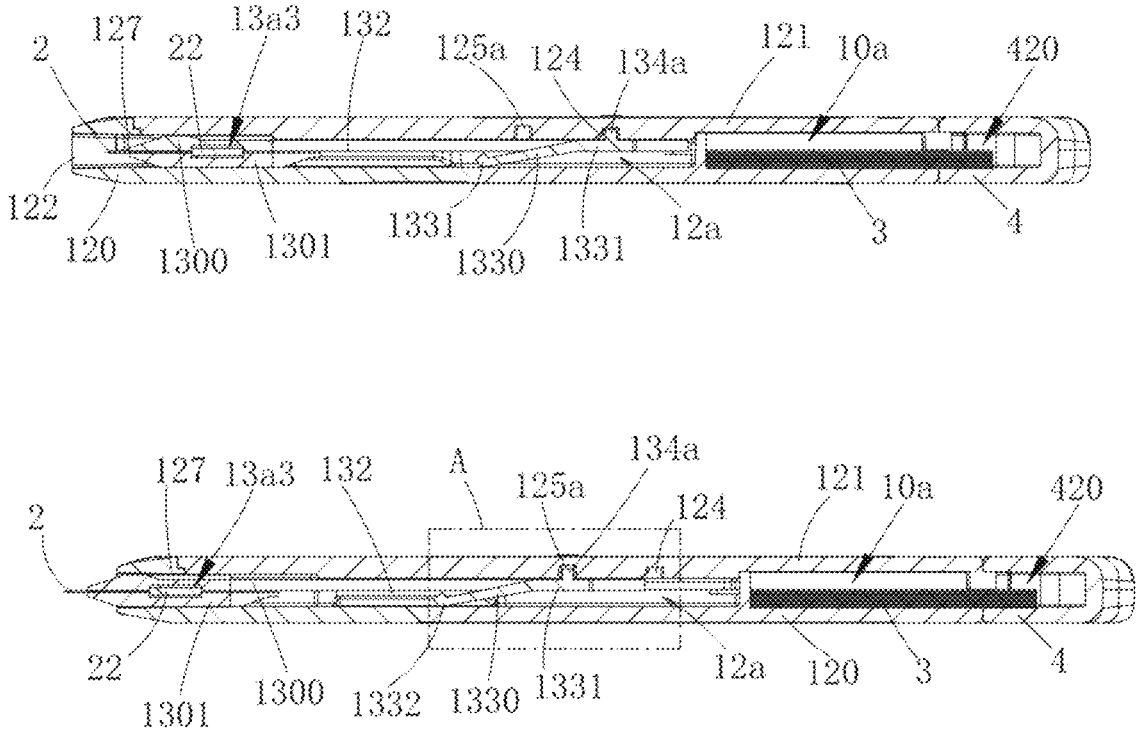
FIG. 12 is a cross-sectional view of the overall structure of the scraper according to some embodiments of the present disclosure, showing the connecting member in a retracted position and a working position.

Referring to FIGS. 12 and 13, when the connecting member 13 is in the retracted position, the scraper may be in a retracted state. To allow quick switching from the retracted state to the working state and improve operational smoothness, the top shell 121 may include a guiding wall 1240 and a first limiting wall 1241 which are arranged opposite each other and cooperatively define the limiting recess 124. The guiding wall 1240 may be arranged close to the locking groove 125*a*, while the first limiting wall 1241 may be arranged away from the locking groove 125*a*. The guiding wall 1240 may be an inclined wall, allowing the limiting boss 134*a* to be quickly disengaged from the limiting recess 124 when switching the scraper from the retracted state to the working state. During this process, the user may not need to press the button portion 131 to a limit position-only a light press and a push of the button portion 131 toward the opening 122 may be required to enable the limiting boss 134*a* to be disengaged from the limiting recess 124. In summary, the guiding wall 1240 may provide as an inclined guide face for the limiting boss 134*a* to enter and exit the limiting recess 124, achieving low-resistance unlocking and enhancing user experience. Conversely, when the connecting member 13 moves from the working position to the retracted position, the guiding wall 1240 may also facilitate a quick entry of the limiting boss 134*a* to the limiting recess 124. The first limiting wall 1241 may be approximately perpendicular to a shell face of the top shell 121, meaning the first limiting wall 1241 may form a roughly 90-degree angle with the sliding direction of the connecting member 13. The first limiting wall 1241 may naturally act as a physical blocking face of the limiting boss 134*a* when the limiting boss 134*a* slides away from the opening 122. When no external force is applied to the button portion 131, the first limiting wall 1241 may serve as a locking mechanism.

Since the working state is a primary usage state of the scraper, to ensure the connecting member 13 is maintained in the working position, as shown in FIG. 13, in some embodiments, the top shell 121 may include a second limiting wall 1250 and a third limiting wall 1251 which are arranged opposite each other, and further include a bottom wall 1252 connected with the second limiting wall 1250 and third limiting wall 1251. The second limiting wall 1250, the third limiting wall 1251, and the bottom wall 1252 may cooperatively define the locking groove 125*a*. The bottom wall 1252 may be approximately parallel to the first inner wall 12*a*1. The second limiting wall 1250 may be arranged close to the limiting recess 124, while the third limiting wall 1251 may be arranged away from the limiting recess 124. Each of the second limiting wall 1250 and third limiting wall 1251 may be similar to the first limiting wall 1241, being approximately perpendicular to the first inner wall 12*a*1, meaning each of the second limiting wall 1250 and third limiting wall 1251 may form an approximately 90-degree angle with the sliding direction of the connecting member 13. When the limiting boss 134*a* is engaged in the locking groove 125*a*, each of the second limiting wall 1250 and third limiting wall 1251 may form a physical blocking face against the sliding of the limiting boss 134*a*. When no external force is applied to the button portion 131, each of the second limiting wall 1250 and third limiting wall 1251 may serve as a locking mechanism.

Referring to FIGS. 10-15, the elastic support portion 133 may include a support leg 1330, a connection end 1331, and a contact end 1332. Each of the connection end 1331 and contact end 1332 may be arranged at a respective one of two ends of the support leg 1330. The support leg 1330 may be obliquely arranged on the connection body 132. The connection end 1331 may be connected with the connection body 132, and the limiting boss 134*a* may be arranged close to the connection end 1331. Specifically, the limiting boss 134*a* may be arranged closer to the connection end 1331 than the contact end 1332. The contact end 1332 may abut against the second inner wall 12*a*2. During operation when the scraper is in the working state, the working blade 2 fixed on the clamping portion 130 may contact a cleaning face M and may be subjected to a reaction force F from the cleaning face M. The reaction force F may be transmitted through clamping portion 130 to the connection body 132. Depending on different inclination directions of the support leg 1330, the reaction force F at the support leg 1330 may have different effects, thereby differently influencing the support leg 1330 and the limiting boss 134*a* formed at the connection end 1331.

Figure 14:
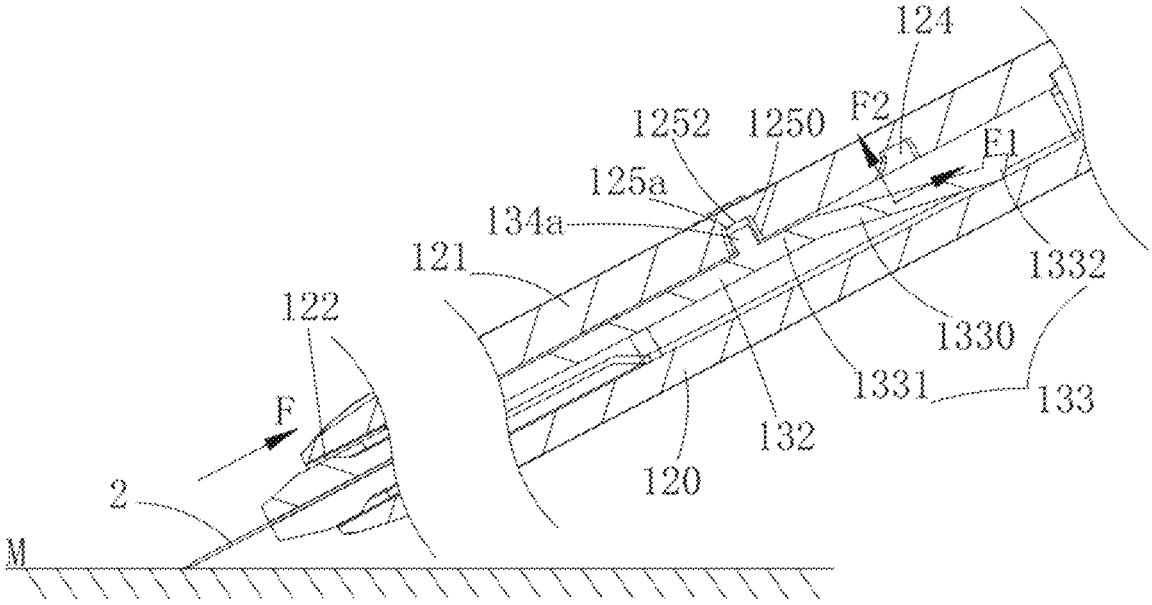
FIG. 14 is a cross-sectional view of a partial structure of the scraper according to some embodiments of the present disclosure, showing a force condition when the support leg is inclined away from the opening.

When the elastic support portion 133 is implemented as the support leg 1330 shown in FIGS. 10 and 14, the support leg 1330 may extend obliquely away from clamping portion 130, meaning when the connecting member 13 is mounted in the mounting cavity 12*a*, the contact end 1332 may be farther from the opening 122 compared to the connection end 1331. In this case, the support leg 1330 may be subjected to a first component force F1 equivalent to the reaction force F, and an elastic preload force F2 of the support leg 1330 after being assembled in the mounting cavity 12*a*, as shown in FIG. 14. The first component force F1 may be directed toward an extension direction of the support leg 1330 from the connection member 132, i.e., the first component force F1 may be away from the limiting boss 134*a*, and the elastic preload force F2 may be directed toward the top shell 121. Using the connection end 1331 at the end of the support leg 1330 as a fulcrum, each of the limiting boss 134*a* and the contact end 1332 may be located on a respective one of two opposite sides of the connection end 1331. An increase in the reaction force F may cause the first component force F1 to increase. When the user pushes the scraper hard, causing the working blade 2 to contact the cleaning face M, an excessive reaction force F may increase the first component force F1. When the first component force F1 is much greater than the elastic preload force F2, using the connection end 1331 as the fulcrum, a lever effect may occur in the support leg 1330 relative to the connection body 132. That is, the contact end 1332 may be forced to displace away from the limiting boss 134*a*, and the contact end 1332 may tend to tilt upward toward the top shell 121, causing the limiting boss 134*a* at the other end of the support leg 1330 to shift away from the locking groove 125*a*. In this way, an engagement depth between the limiting boss 134*a* and the locking groove 125*a* may be gradually reduced. The increase in the first component force F1 may further accelerate the disengagement of the limiting boss 134*a* from the locking groove 125*a*, causing the locking mechanism of the limiting boss 134*a* to fail. The working blade 2 may be retracted in the mounting cavity 12*a* and cannot be maintained in the working state for cleaning, leading to a degraded user experience.

Figure 15:
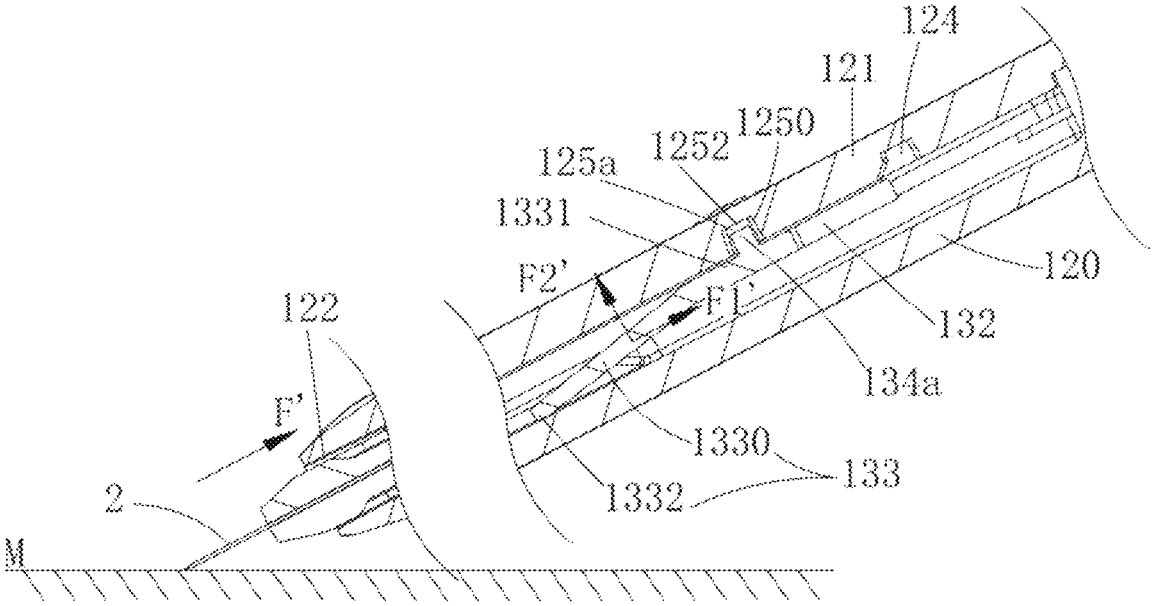
FIG. 15 is a cross-sectional view of the partial structure of the scraper according to some embodiments of the present disclosure, showing a force condition when the support leg is inclined towards the opening.

Conversely, when the elastic support portion 133 is implemented as the support leg 1330 as shown in FIGS. 11 and 15, the support leg 1330 may extend obliquely toward the clamping portion 130. That is, after the connecting member 13 is mounted in the mounting cavity 12*a*, the contact end 1332 may be closer to the opening 122 compared to the connection end 1331. In this case, the support leg 1330 may be subjected to a first component force F1' equivalent to the reaction force F', and an elastic preload force F2' of the support leg 1330 after being assembled in the mounting cavity 12*a*, as shown in FIG. 15. The first component force F1' may be opposite to the extension direction of the support leg 1330 from the connection member 132, i.e., the first component force F1' may be directed toward the limiting boss 134*a*, and the elastic preload force F2' may be directed toward the top shell 121. Using the connection end 1331 at the end of the support leg 1330 as the fulcrum, each of the limiting boss 134*a* and the contact end 1332 may be located on a respective one of two opposite sides of the connection end 1331. An increase in the reaction force F' may cause the first component force F1' to increase. When the user pushes the scraper hard, causing the working blade 2 to contact the cleaning face M, an excessive reaction force F' may increase the first component force F1'. When the first component force F1' is much greater than the elastic preload force F2', the contact end 133 may be subjected to force and deform. However, since the direction of the first component force F1' acting on the support leg 1330 is toward the limiting boss 134*a*, i.e., the direction of the first component force F1' is the same as the direction in which the limiting boss 134*a* engages the locking groove 125*a*, an increase in the first component force F1' may cause the limiting boss 134*a* to press more tightly against the second limiting wall 1250 and the bottom wall 1252 of the locking groove 125*a*. This may prevent the limiting boss 134*a* from being disengaged from the locking groove 125*a*, cleverly converting the reaction force F' to a locking force that may enhance locking ability of the limiting boss 134*a*. In this way, the working blade 2 may be ensured to remain in the working state for cleaning, improving the user experience when using the scraper.

It should also be noted that in other embodiments, the cooperating portion 134 may be implemented as a groove structure while the locking portion 125 may be implemented as a protrusion structure that may be engaged in the groove structure. Alternatively, each of the cooperating portion 134 and locking portion 125 may adopt the protrusion structure. The specific structures of the aforementioned cooperating portion 134 and locking portion 125 may all be arranged according to the support leg 1330 shown in FIG. 15 to achieve a locking effect of the connecting member 13 in the working position. Moreover, the locking portion 125 may alternatively be formed on an inner wall of the top shell body 121 along a thickness direction of the mounting cavity 12*a* (i.e., on an inner wall other than the first inner wall 12*a*1 and the second inner wall 12*a*2), with the cooperating portion 134 correspondingly arranged at a position of the connection body 132 engageable with the locking portion 125.

Referring to FIGS. 5, 8, 9, and 12, in some embodiments, the clamping portion 130 may include a clamping base plate 1300 and a clamping cover plate 1301. The clamping base plate 1300 and the connection body 132 may be integrally formed as a one-piece structure, and the clamping base plate 1300 may be arranged at one end of the connection body 132. The clamping cover plate 1301 and the clamping base plate 1300 may be arranged opposite each other and cooperatively define a clamping gap 13*a* with an exposure opening 13*a*1, and the exposure opening 13*a*1 may be formed away from the connection body 132. The working blade 2 may be fastened in the clamping gap 13*a*, and a blade edge 21 of the working blade 2 may extend out through the exposure opening 13*a*1. Specifically, the clamping base plate 1300 may extend from one end of the connection body 132. An end of the clamping cover plate 1301 may be fixedly or detachably connected to the connection body 132, so that the clamping cover plate 1301 and the clamping base plate 1300 may cooperatively define the clamping gap 13*a*. Each of the clamping base plate 1300 and the clamping cover plate 1301 may have a certain capacity for elastic deformation. When the working blade 2 is placed in the clamping gap 13*a*, the clamping base plate 1300 and the clamping cover plate 1301 may stably clamp the working blade 2.

Referring to FIGS. 5, 8, 9, and 12, in some embodiments, the clamping gap 13*a* may further include a clamping section 13*a*2 and a guiding section 13*a*3. A thickness D1 of the guiding section 13*a*3 may be greater than a thickness D2 of the clamping section 13*a*2. The clamping section 13*a*2 may receive a portion of the working blade 2 to be clamped by the clamping base plate 1300 and the clamping cover plate 1301, and the guiding section 13*a*3 may assist in mounting and removal of the working blade 2. When the working blade 2 is in the working position, the guiding section 13*a*3 may be located in the mounting cavity 12*a*. Specifically, the working blade 2 and the spare blade 3 may be the same type of blade, both include a blade body 20, a blade edge 21 arranged at one end of the blade body 20, and an edged portion 22 arranged at the other end of the blade body 20. The following description uses the working blade 2 as an example. A thickness D3 of the edged portion 22 of the working blade 2 may be greater than a thickness D4 of the blade body 20.

Based on this, the clamping base plate 1300 may include a first connection end 1303 and a first clamping face 1302. The clamping cover plate 1301 may include a second connection end 1305 and a second clamping face 1304. The first connection end 1303 may be detachably connected to the second connection end 1305. The first clamping face 1302 and the second clamping face 1304 may cooperatively define the clamping gap 13*a*. A portion of the first clamping face 1302 close to the first connection end 1303 may define a first recess 13*a*4. A portion of the second clamping face 1304 close to the second connection end 1305 may define a second recess 13*a*5. The first recess 13*a*4 may extend across the first clamping face 1302 in a width direction of the clamping portion 130, and the second recess 13*a*5 may extend across the second clamping face 1304 in the width direction of the clamping portion 130. The first recess 13*a*4 and the second recess 13*a*5 may cooperatively form the guiding section 13*a*3. A remaining portion of the first clamping face 1302 and a remaining portion of the second clamping face 1304 cooperatively define the clamping section 13*a*2.

When no external force is applied, a thickness D1 of the guiding section 13*a*3 (a distance between an inner face of the clamping base plate 1300 and an inner face of the clamping cover plate 1301 at the guiding section 13*a*3) may be slightly greater than or equal to a thickness D3 of the edged portion 22 of the working blade 2. A thickness D2 of the clamping section 13*a*2 (a distance between the inner face of the clamping base plate 1300 and the inner face of the clamping cover plate 1301 at the clamping section 13*a*2) may be slightly less than or equal to a thickness D4 of the blade body 20 of the working blade 2. Since the thickness D4 of the blade body 20 of the working blade 2 is very small, while the thickness D3 of the edged portion 22 is larger, it is convenient for the user to contact and apply force. Therefore, the thickness D1 of the guiding section 13*a*3 may be arranged to be similar to the thickness D3 of the edged portion 22. After the blade body 20 is aligned with the clamping section 13*a*2, the edged portion 22 may be inserted horizontally (in a width direction of the housing 1) in the guiding section 13*a*3, thereby mounting the working blade 2 in the clamping gap 13*a*. Similarly, by pushing the edged portion 22 horizontally (in the width direction of the housing 1), the edged portion 22 may be disengaged from the guiding section 13*a*3, and the entire working blade 2 may be removed from the clamping gap 13*a*.

Figure 5:
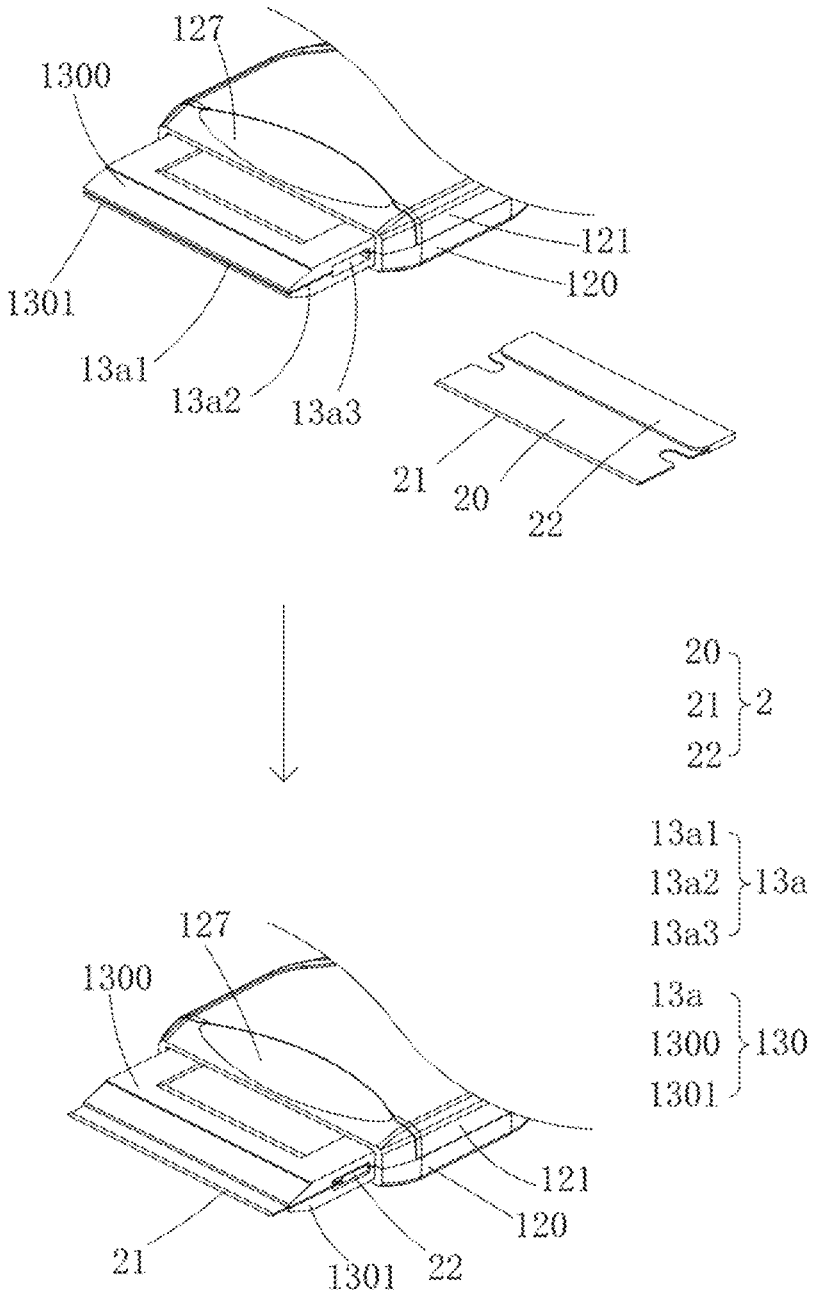
FIG. 5 is a first structural view of a clamping portion and a working blade of the scraper according to some embodiments of the present disclosure, showing the working blade separated from the clamping portion and the working blade assembled on the clamping portion.

Based on the above, when the connecting member 13 is in the working position, as shown in FIG. 12, the guiding section 13*a*3 may be located in the mounting cavity 12*a*, an opening of the guiding section 13*a*3 in the width direction of the guiding section 13*a*3 may be blocked by an inner wall of housing 12 at the mounting cavity 12*a*, preventing the edged portion 22 of the working blade 2 from sliding out along the width direction of the clamping portion 130. When the working blade 2 is in the replacement position, as shown in FIG. 5, the guiding section 13*a*3 may extend out of the mounting cavity 12*a* through the opening 122, and the opening of the guiding section 13*a*3 in the width direction of the guiding section 13*a*3 may be exposed. In this case, by pushing the edged portion 22 of the working blade 2 along the width direction of the clamping portion 130, the edged portion 22 and the blade body 20 may be disengaged from the clamping gap 13*a* in the width direction of the clamping portion 130. Conversely, by inserting the working blade 2 in the clamping gap 13*a* in the width direction of the clamping portion 130, the edged portion 22 of the working blade 2 may be placed in the guiding section 13*a*3, the blade body 20 may be placed in the clamping section 13*a*2, and the blade edge 21 may extend out through the exposure opening 13*a*1 of the clamping gap 13*a*.

Figure 8:
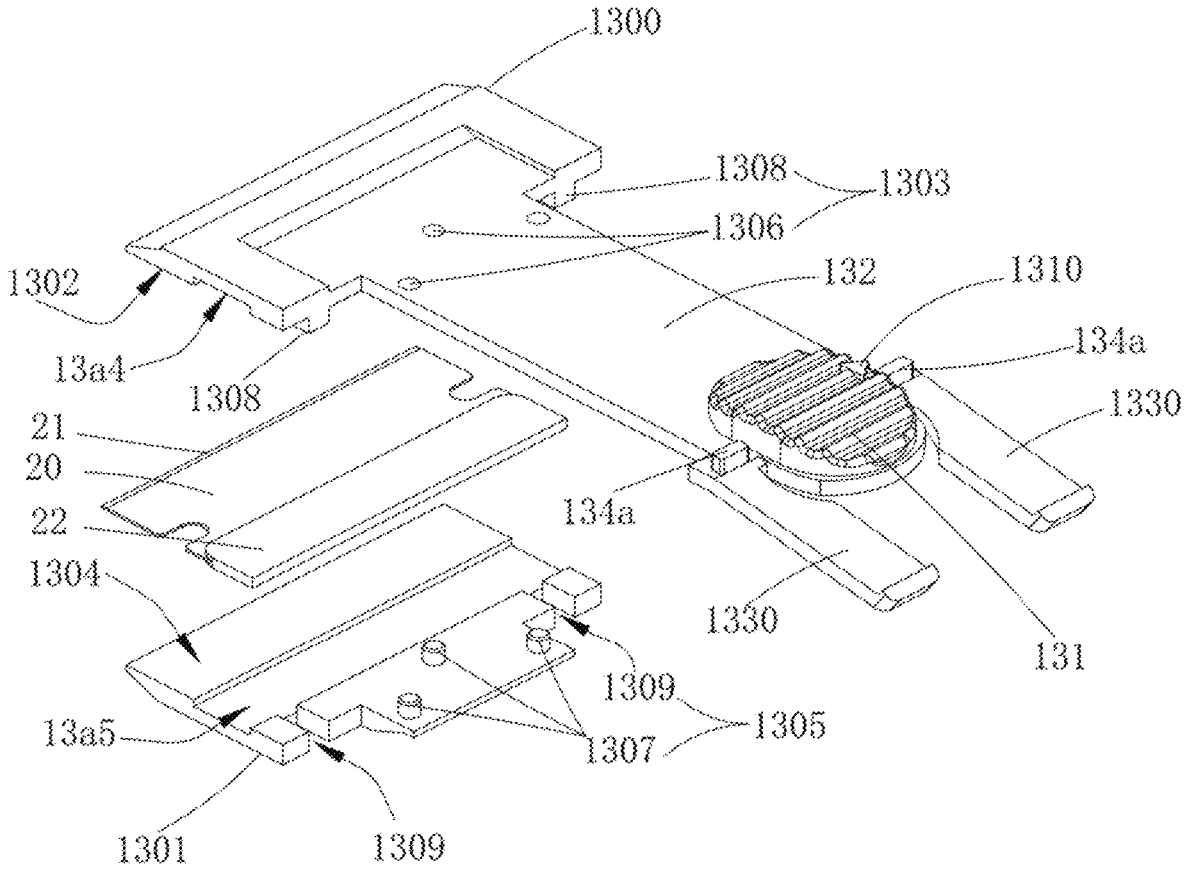
FIG. 8 is a first structural view of a connecting member according to some embodiments of the present disclosure.
Figure 9:
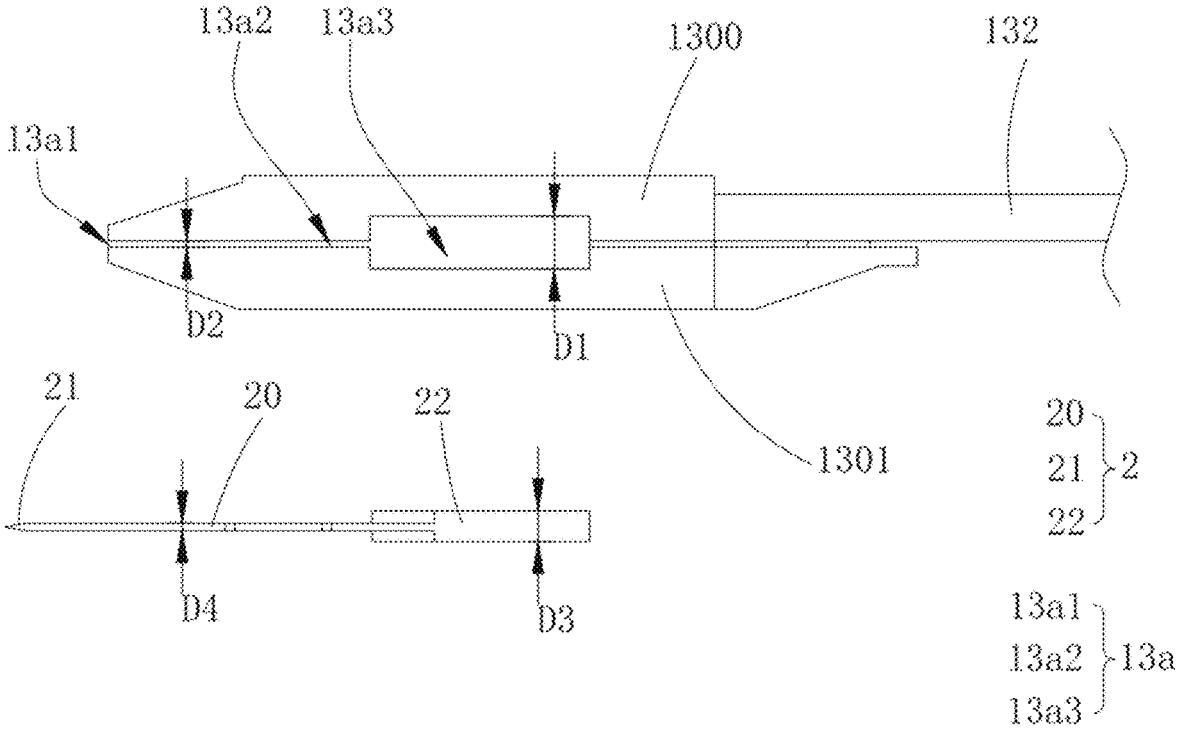
FIG. 9 is a second structural view of the clamping portion and the working blade according to some embodiments of the present disclosure, showing the working blade separated from the clamping portion.

In some embodiments, one of the clamping base plate 1300 and the clamping cover plate 1301 may define a locking hole 1306, and the other of the clamping base plate 1300 and the clamping cover plate 1301 may be arranged with a locking protrusion 1307. Referring to FIG. 8, the clamping base plate 1300 may define a plurality of locking holes 1306. The plurality of locking holes 1306 may be spaced apart from each other and distributed in the first connection end 1303. The clamping cover plate 1301 may include a plurality of locking protrusions 1307. The plurality of locking protrusions 1307 may be spaced apart from each other and distributed on the second connection end 1305. The plurality of locking protrusions 1307 may be engaged in the plurality of locking holes 1306 in a one-to-one correspondence for fixing the clamping base plate 1300 and the clamping cover plate 1301. When three locking holes 1306 and three locking protrusions 1307 are provided, the three locking holes 1306 may be distributed in a triangular pattern in the first connection end 1303, located at two endpoints and a middle position of the first connection end 1303, respectively. Similarly, the three locking protrusions 1307 may be arranged on the second connection end 1305. The three locking protrusions 1307 may be spaced apart from each other and form a triangular distribution, so that a fool-proof design between the clamping base plate 1300 and the clamping cover plate 1301 may be created, which may facilitate the clamping cover plate 1301 to be engaged withs the clamping base plate 1300. Furthermore, a cooperation of the plurality of spaced holes and protrusions may enhance fastening stability between the clamping cover plate 1301 and the clamping base plate 1300.

To further improve the connection stability between the clamping base plate 1300 and the clamping cover plate 1301, one of the clamping base plate 1300 and the clamping cover plate 1301 may be arranged with a limiting protrusion 1308, and the other of the clamping base plate 1300 and the clamping cover plate 1301 may define a plurality of limiting grooves 1309. Specifically, the clamping base plate 1300 may further be arranged with a plurality of limiting protrusions 1308. The plurality of limiting protrusions 1308 may be spaced apart from each other and distributed in the first connection end 1303. The clamping cover plate 1301 may further define a plurality of limiting grooves 1309. The plurality of limiting grooves 1309 may be spaced apart from each other and distributed in the second connection end 1305. The plurality of limiting protrusions 1308 may be engaged in the plurality of limiting grooves 1309 in a one-to-one correspondence. As shown in FIG. 8, when two limiting protrusions 1308 and two limiting grooves 1309 are provided, the two limiting protrusions 1308 may be spaced apart from each other along a width direction of the clamping base plate 1300 on both sides of the clamping base plate 1300, i.e., each of the two limiting protrusions 1308 may be located on a respective one of both sides of the first connection end 1303. The two limiting protrusions 1308 may be located close to the first clamping face 1302. Similarly, the two limiting grooves 1309 may be formed in the second connection end 1305, thereby enhancing fastening stability between the clamping base plate 1300 and the clamping cover plate 1301. Furthermore, a direction in which the locking protrusions 1307 are inserted in the locking holes 1306 may be opposite to a direction in which the limiting protrusions 1308 are inserted in the limiting grooves 1309, so that the first connection end 1303 and the second connection end 1305 may form a reverse snap connection, further strengthening the connection stability between the clamping cover plate 1301 and the clamping base plate 1300. It should also be noted that when the working blade 2 is in the storage position, working position, or replacement position, both the first connection end 1303 and the second connection end 1305 may be located in the mounting cavity 12*a*.

It should also be noted that, in other embodiments, the first connection end 1303 and the second connection end 1305 may be integrally formed as a one-piece structure. Specifically, a relatively thick plate-like structure may extend from one end of the connection body 132, and the clamping gap 13*a* may be formed by penetrating through the relatively thick plate-like structure in a width direction of the relatively thick plate-like structure.

Figure 2:
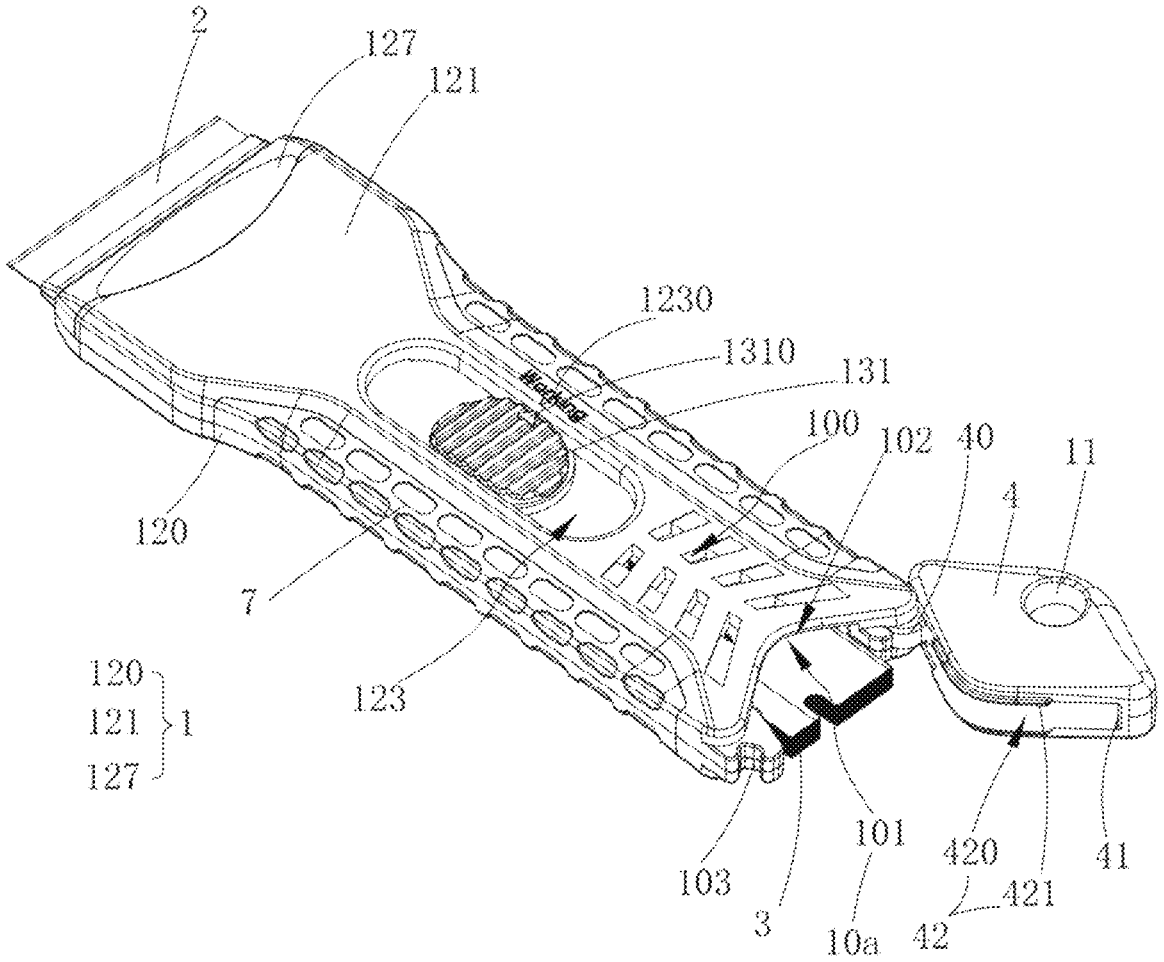
FIG. 2 is a second schematic view of the overall structure of the scraper according to some embodiments of the present disclosure.
Figure 3:
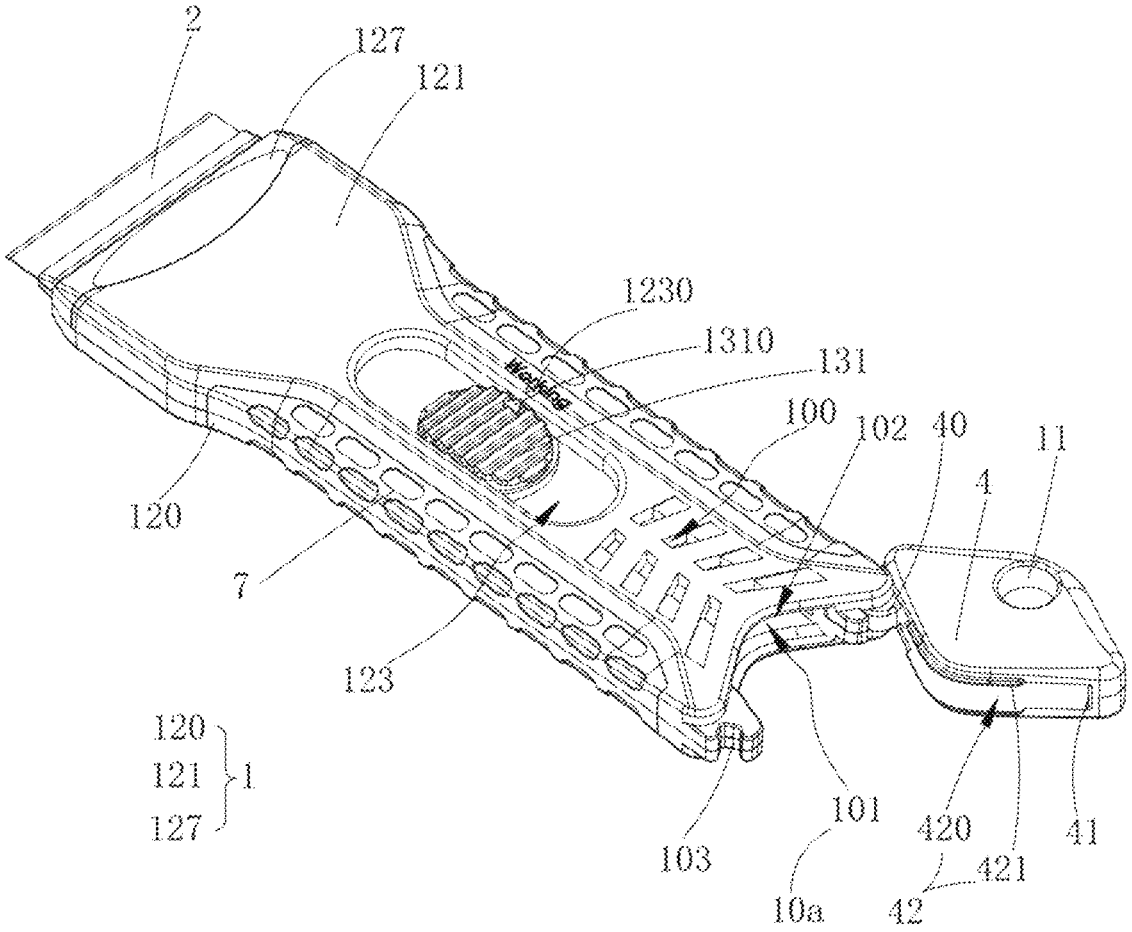
FIG. 3 is a third schematic view of the overall structure of the scraper according to some embodiments of the present disclosure.
Figure 4:
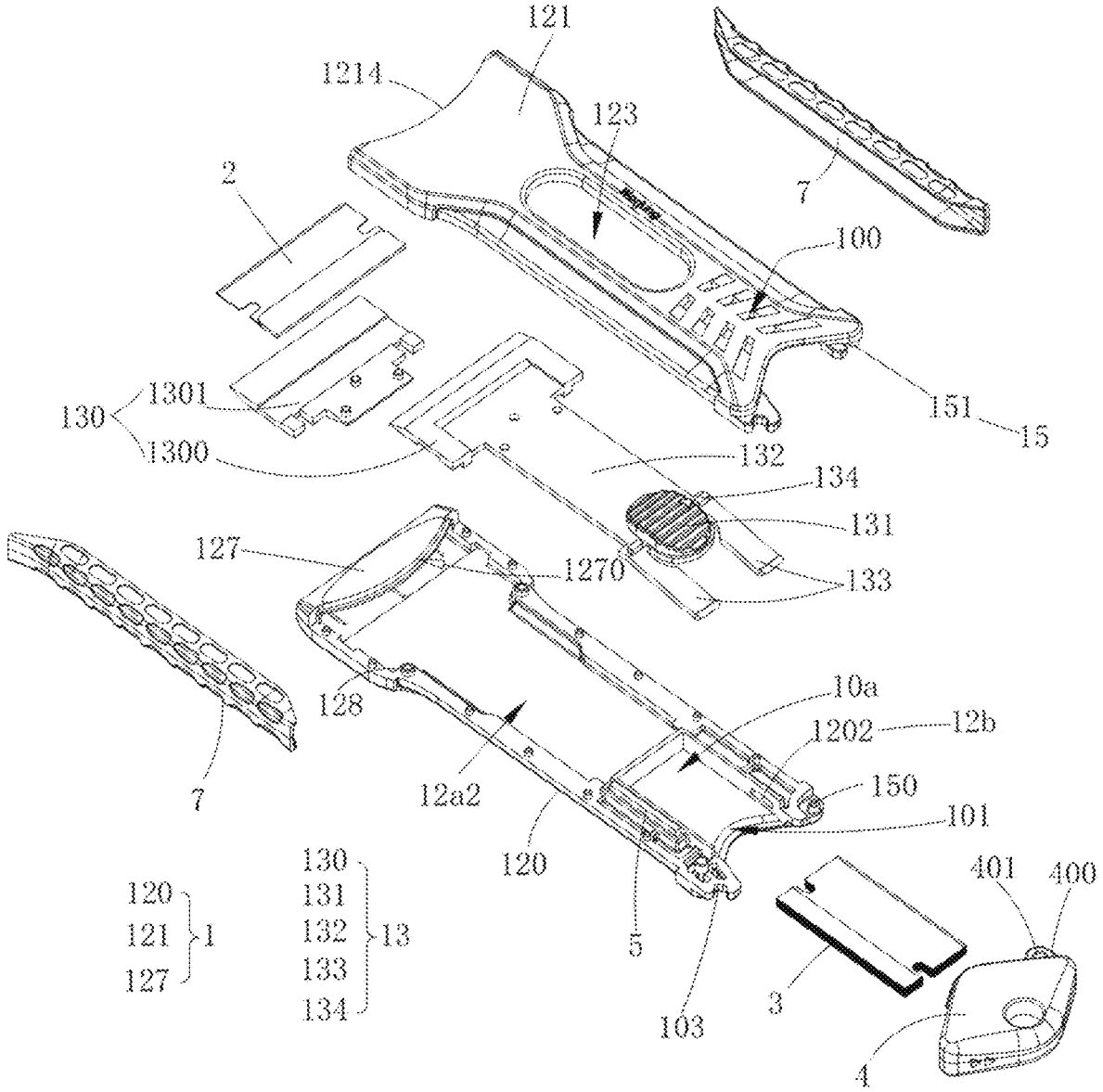
FIG. 4 is an exploded view of the scraper according to some embodiments of the present disclosure.

Referring to FIGS. 2, 3, and 4, in some embodiments, the housing 1 may also internally define a receiving cavity 10*a* for storing spare blades 3. The housing 1 may define a viewing window 100 communicating the receiving cavity 10*a* with an exterior of the housing 1, for viewing a remaining amount of the spare blades 3 in the receiving cavity 10*a*.

Specifically, the housing 1 may substantially be a flat, elongated structure with a front end and a rear end that may be distant from each other. The front end may be used for mounting the working blade 2, facilitating the user to hold the housing 1 and push the working blade 2 for cleaning work. A main part of the housing 1 may form the mounting cavity 12*a*, used for accommodating the connecting member 13. The receiving cavity 10*a* may be formed in a rear end of the housing 11. A width dimension of the receiving cavity 10*a* may be greater than a thickness dimension of the receiving cavity 10*a*. The width of the receiving cavity 10*a* may be slightly greater than the width of the spare blades 3, so that the stored spare blades 3 may less be prone to shaking in the width direction of the receiving cavity 10*a*. The thickness of the receiving cavity 10*a* may be much greater than the thickness of one spare blade 3, allowing a plurality of spare blades 3 to be stacked in the receiving cavity 10*a*. The viewing window 100 may be formed on a wall face of the receiving cavity 10*a* in the width direction of the receiving cavity 10*a* or the thickness direction of the receiving cavity 10*a*. For example, the viewing window 100 may be formed on a wall face in the width direction of the receiving cavity 10*a*. The wall face in the width direction may provide a larger viewing area, ensuring the user may clearly observe the remaining amount of the spare blades 3. In other embodiments, the viewing window 100 may be replaced with a glass plate or acrylic plate made of a transparent material, or a transparent glass or acrylic plate may be mounted in the viewing window 100. In summary, by providing an observation window communicated with the exterior of the housing 1, the user may observe the remaining amount of the spare blade 3 in the receiving cavity 10*a* in real time, avoiding the situation where there is no spare blade 3 available for replacement in the receiving cavity 10*a* during use. This allows the user to promptly take a spare blade 3 from the receiving cavity 10*a* when the working blade 2 needs replacement, improving the user experience when using this scraper.

In some embodiments, a plurality of viewing windows 100 may be provided. The plurality of viewing windows 100 may be spaced apart from each other along a length direction of the receiving cavity 10*a*. The multi-window design may expand user's viewing range, allowing a precise observation of the amount of spare blades 3 stacked in the receiving cavity 10*a*. Furthermore, a single viewing window 100 may have an elongated or circular outline. The plurality of viewing windows 100 may form some regular grid patterns, which not only expand a viewing range of the receiving cavity 10*a* but also enhance an aesthetic appeal of the scraper.

In some embodiments, a wall face of the housing 1 at the rear end of the housing 1 may define an access opening 101. The access opening 101 may communicate the receiving cavity 10*a* with the exterior of the housing 1, providing an access channel for the spare blades 3 and improving efficiency of blade replacement. The access opening 101 may be specifically formed on a rear wall face of the rear end of the housing 1. In other embodiments, the access opening 101 may also be formed on a side wall face of the rear end of the housing 1 or a top wall face of the rear end of the housing 1.

Referring to FIGS. 2-4, in some embodiments, the scraper may further include a cover 4. The cover 4 may cover the access opening 101. Covering the access opening 101 with the cover 4 may prevent the spare blade 3 from disengaging from the receiving cavity 10*a* through the access opening 101. Specifically, the cover 4 may include a hinge portion 40 and an engagement portion 41. The hinge portion 40 may be hinged to the housing 1. The engagement portion 41 may rotate about the hinge portion 40. The rear end of the housing 1 may define an engagement recess 103 that cooperates with the engagement portion 41. Each of the hinge portion 40 and the engagement portion 41 may be located at a respective one of two ends of the cover 4 on a same side of the cover 4. The hinge portion 40 may protrude and extend from the cover 4. A notch for accommodating the hinge portion 40 may be formed at the rear end of the housing 1, enabling the hinge portion 40 to hinge with the housing 1. The engagement portion 41 may be arranged as an inverted hook. The inverted hook may be engaged in the engagement recess 103 formed at the rear end of the housing 1. Edges of the hosing 1 at the engagement recess 103 may have rounded corners to facilitate the engagement portion 41 to be engaged in or disengaged from the engagement recess 103. It should also be noted that the hinge portion 40 may include a connection arm 400 protruding from the cover 4 and a connection through hole 401 formed in the connection arm 400. The housing 1 may be arranged with a shaft rod 15 in the notch at the rear end of the housing 1. The shaft rod 15 may be rotatably arranged in the connection through hole 401. A height of the notch may be approximately the same as a thickness of the connection arm 400, ensuring that when the connection arm 400 is hinged in the notch, there is no shaking of the connection arm 400 in the thickness direction of the connection arm 400, thereby improving the connection stability at this position.

Referring to FIGS. 2 and 3, in some embodiments, the housing 1 may define an operation notch 102 at the access opening 101. At least a portion of the spare blades 3 may extend out of the receiving cavity 10*a* through the operation notch 102. Specifically, a portion of the housing 1 at the operation notch 102 may be recessed towards the front end of the housing 1. The cover 4 may be arranged with a protruding portion 42 that may cooperate with the operation notch 102. When the cover 4 is opened, part of the spare blades 3 may be exposed through the operation notch 102, facilitating user access. The corresponding protruding portion 42 on the cover 4 may ensure that when the cover 4 closes the opening, the spare blades 3 may not be exposed, making an overall structure of the scraper more compact. To prevent the protruding portion 42 from squeezing the spare blades 3, a receiving groove 420 may be formed on the protruding portion 42. When the cover 4 covers the access opening 101, the protruding portion 42 may be embedded in the operation notch 102, and at least part of the spare blades 3 may be located in the receiving groove 420. Furthermore, the protruding portion 42 may also include two guiding strips 421. The guiding strips 421 may extend along an opening of the receiving groove 420, and the two guiding strips 421 may be symmetrically distributed on both sides of the opening of the receiving groove 420. When the cover 4 covers the access opening 101, the two guiding strips 421 may be embedded in the receiving cavity 10*a* through the access opening 101. Each of the two guiding strips 421 may be tightly engaged with a respective one of two opposite inner walls of the housing 1 at the receiving cavity 10*a*, further enhancing the stability of the cover 4 after the cover 4*t* covers the access opening 101.

Referring to FIG. 3, in some embodiments, the scraper may define a hanging through hole 11. Specifically, the hanging through hole 11 may be formed in the cover 4. The hanging through hole 11 may allow the scraper to be carried with a lanyard or hung on a wall peg. In other embodiments, the hanging through hole 11 may also be formed on the housing 1.

Referring to FIG. 4, in some embodiments, the scraper may further include at least one magnetic member 5. The at least one magnetic member 5 may be mounted in the housing 1 and may adsorb the spare blades 3 in the receiving cavity 10*a*. Specifically, the magnetic member 5 may be arranged on a side wall of the receiving cavity 10*a* or arranged close to the side wall. Adsorbing the spare blades 3 in the receiving cavity 10*a* by the magnetic member 5 may prevent the spare blades 3 from being pulled out of the receiving cavity 10*a* when the cover 4 is opened. Furthermore, a thickness direction of the receiving cavity 10*a* may be the same as a thickness direction of the spare blades 3. The magnetic member 5 may be arranged close to a wall face of the receiving cavity 10*a* in the thickness direction of the receiving cavity 10*a*. By arranging the magnetic member 5 close to a side wall of the housing 1 in the thickness direction of the receiving cavity 10*a*, adjacent spare blades 3 may be separated due to magnetic moment, facilitating user access. It should be noted that a plurality of magnetic members 5 may be arranged close to the receiving cavity 10*a* to increase a magnetic force adsorbing the spare blade 3. The magnetic member 5 may specifically be a structure with magnetism, such as a magnet, an electromagnet, a soft magnetic strip, etc.

Referring to FIGS. 4, 12, 14, and 15, each of the mounting cavity 12*a* and the receiving cavity 10*a* may be formed by the engagement between the bottom shell 120 and the top shell 121. Specifically, the mounting cavity 12*a* may serve as a main chamber of the housing 1, and the receiving cavity 10*a* may be located at the rear end of the housing 1, i.e., the end away from the opening 122. Each of the bottom shell 120 and the top shell 121 may be elongated, flat plate-like structures. The housing 1 may include a connecting bridge 127. The connecting bridge 127 and the bottom shell 120 may be integrally formed as a one-piece structure, and the connecting bridge 127 may be arranged at the front end of the bottom shell 120. The connecting bridge 127 and a bottom wall of the bottom shell 120 may cooperatively define the opening 122. The connecting bridge 127 may include an exposed end wall and a limiting end wall 1270 in a length direction of the bottom shell 120. An exposed face of the connecting bridge 127 may be flush with a front end face of the bottom shell 120. The limiting end wall 1270 may face the rear end of the bottom shell 120. When the top shell 121 is engaged with the bottom shell 120, a front end wall of the top shell 121 may abut against the limiting end wall 1270, and the rear end of the top shell 121 may be flush with the rear end of the bottom shell 120, forming the access opening 101. It should also be noted that a thickness of the connecting bridge 127 may be approximately the same as a thickness of the top shell 121, so that after the top shell 121 is engaged with the bottom shell 120, a surface of the top shell 121 may smoothly transition to the surface of the connecting bridge 127. During use, the bottom shell 120 may face the cleaning face M, and the working blade 2 may extend out of the mounting cavity 12*a* through the opening 122. When the user holds the housing 1 and uses the working blade 2 to clean the cleaning face M, the reaction force F from the cleaning face M acting on the working blade 2 may be transmitted to the connecting bridge 127, causing the limiting end wall 1270 and the front end wall of the top shell 121 to abut against each other more tightly, thereby strengthening the connection stability between the top shell 121 and the bottom shell 120 during use, preventing cracks or separation at a connection position of the bottom shell 120 and the top shell 121 during operation.

Referring to FIGS. 6 and 7, in some embodiments, the bottom shell 120 may be arranged with a plurality of fastening positioning protrusions 1200. The plurality of fastening positioning protrusions 1200 may be evenly distributed along edges of the bottom shell 120. The top shell 121 may correspondingly define a plurality of fastening positioning recesses 1210 that correspond to the plurality of fastening positioning protrusions 1200. When the top shell 121 covers the bottom shell 120, the plurality of fastening positioning protrusions 1200 may be engaged in the plurality of fastening positioning recesses 1210 in a one-to-one correspondence, preventing misalignment between the top shell 121 and the bottom shell 120 in both the length and width directions of the scraper. Furthermore, the engagement between the fastening positioning recesses 1210 and the fastening positioning protrusions 1200 may make it difficult for the top shell 121 and the bottom shell 120 to separate from each other in the thickness direction. It should also be noted that an outer diameter of each of the fastening positioning protrusions 1200 located at four corners of the bottom shell 120 may be made larger than an outer diameter of each of other fastening positioning protrusions 1200. The corresponding fastening positioning recesses 1210 at four corners of the top shell 121 may be adaptively adjusted to match the fastening positioning protrusions 1200 located at four corners of the bottom shell 120. The larger fastening positioning protrusions 1200 and fastening positioning recesses 1210 at the corners may serve for positioning and basic engagement between the top shell 121 and the bottom shell 120, while the remaining smaller fastening positioning protrusions 1200 and fastening positioning recesses 1210 may serve to assist and strengthen the engagement between the top shell 121 and the bottom shell 120.

Referring to FIGS. 6 and 7, in some embodiments, the front end of the top shell 121 may be arranged with at least two first engagement hooks 1211. The at least two first engagement hooks 1211 may be symmetrically distributed along a width direction of the top shell 121. The bottom shell 120 may correspondingly define at least two first hook recesses 1201 that correspond to the at least two first engagement hooks 1211. The at least two first hook recesses 1201 may be located close to the connecting bridge 127. When the top shell 121 covers the bottom shell 120, each of the first engagement hooks 1211 may be inserted in a respective one of the first hook recesses 1201, and each of the first engagement hooks 1211 may be engaged in the respective one of the first hook recesses 1201, thereby strengthening the connection stability between the top shell 121 and the bottom shell 120 in the thickness direction of the scraper.

Referring to FIGS. 6 and 7, in some embodiments, the rear end of the top shell 121 may be arranged with at least one locking engagement hook 1212. The bottom shell 120 may correspondingly define at least one locking hook recess 1202 that corresponds to the at least one locking engagement hook 1212. When the top shell 121 covers the bottom shell 120, the locking engagement hook 1212 may be inserted in and engaged in the locking hook recess 1202, thereby further strengthening the connection stability between the top shell 121 and the bottom shell 120 in the thickness direction of the scraper. In this way, a stable engagement between all parts of the top shell 121 and the bottom shell 120 may be ensured, and a higher hinge stability between the cover 4 and the rear end of the housing 1 may be achieved.

It should also be noted that, in other embodiments, the first engagement hooks 1211 and the locking engagement hooks 1212 may be arranged on the bottom shell 120, and the first hook recesses 1201 and the locking hook recesses 1202 may be correspondingly formed in the top shell 121.

To further enhance the connection strength between the bottom shell 120 and the top shell 121 and to improve the user's grip feel, in some embodiments, the scraper may further include two soft rubber sleeves 7. As shown in FIGS. 1 to 4, the two soft rubber sleeves 7 may be symmetrically arranged on both sides of the housing 1. Each of the two soft rubber sleeves 7 may simultaneously wrap around both the bottom shell 120 and the top shell 121, improving the connection strength between the bottom shell 120 and the top shell 121 in the thickness direction of the scraper. The soft rubber sleeve 7 may extend from the front end of the housing 1 to the rear end of the housing 1, which may not only enhance the connection stability between the bottom shell 120 and the top shell 121 but also prevent cracks from forming between the bottom shell 120 and the top shell 121 in the length direction of the scraper. The soft rubber sleeves 7 may be fixed to corresponding positions of the housing 1 by heat melting. The characteristic of the soft rubber sleeves 7 may reduce potential discomfort to the user's palm when using the scraper for a long time. Furthermore, anti-slip patterns may be arranged on the soft rubber sleeves 7 to increase friction between the user's palm and the soft rubber sleeve 7, ensuring a stable grip on the scraper.

Referring to FIGS. 4, 6, and 7, in some embodiments, the shaft rod 15 may include a positioning shaft 150 arranged on the bottom shell 120 and an insertion rod portion 151 arranged on the top shell 121. The insertion rod portion 151 may be coaxially engaged with the positioning shaft 150. Specifically, an end wall of the positioning shaft 150 may define an insertion hole for insertion of the insertion rod portion 151. During assembly, the connection arm 400 of the cover 4 may be sleeved on the positioning shaft 150 through the connection through hole 401. Then, the insertion rod portion 151 of the top shell 121 may be inserted in the connection through hole 401 and engaged with the positioning shaft 150. In this way, the cover 4 is hinged to the housing 1.

In some embodiments, the locking engagement hook 1212 and the locking hook recess 1202 may cooperatively form a shaft reinforcement portion 12*b*. The shaft reinforcement portion 12*b* may be located close to the shaft rod 15. By connecting the top shell 121 and the bottom shell 120 via the shaft reinforcement portion 12*b*, the connection stability between the top shell 121 and the bottom shell 120 may be improved. Specifically, the locking engagement hook 1212 may be located particularly close to the hinge portion 40 of the cover 4. The locking hook recess 1202 may be specifically formed on a wall of the housing 1 at the receiving cavity 10*a*. An engagement between the locking engagement hook 1212 and the locking hook recess 1202 may serve two purposes: firstly, it may enhance the connection stability between the bottom shell 120 and the top shell 121 at the rear end of the housing 1; secondly, during the opening and closing of the cover 4 for the receiving cavity 10*a*, forces in the thickness direction of the scraper may inevitably be applied, which can easily cause cracking between the bottom shell 120 and the top shell 121 at the cover 4, and make the insertion rod portion 151 prone to disengage from the positioning shaft 150 and the connection through hole 401. By arranging the locking engagement hook 1212 and the locking hook recess 1202 close to the hinge portion 40, axial limiting for the insertion rod portion 151 and the positioning shaft 150 may be achieved, preventing the insertion rod portion 151 and the positioning shaft 150 from separating axially from each other and thereby improving the connection stability between the cover 4 and the housing 1. In other embodiments, a plurality of locking engagement hooks 1212 and a plurality of locking hook recesses 1202 may be provided. The plurality of locking engagement hooks 1212 may be distributed as needed at various positions of the top shell 121 that are prone to cracking at the rear end of the top shell 121.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

What is claimed is:

1. A scraper, comprising:

a housing, defining a mounting cavity with an opening and a guiding hole communicated with the mounting cavity;

a connecting member, slidably mounted in the mounting cavity and comprising:

a connection body;

a button portion, connected to the connection body and at least partially arranged in the guiding hole, wherein the button portion is configured to be pushed to enable the connection body to slide in the mounting cavity; and a clamping portion, connected to an end of the connection body and configured to fasten a working blade, wherein the working blade is configured to at least partially extend out of the mounting cavity or to be retracted in the mounting cavity through the opening;

wherein:

the clamping portion comprises a clamping base plate and a clamping cover plate, the clamping base plate is connected to the end of the connection body, the clamping cover plate is arranged opposite the clamping base plate, and the clamping cover plate and the clamping base plate cooperatively define a clamping gap with an exposure opening, the exposure opening is located at an end of the clamping portion away from the connection body, the working blade is mounted in the clamping gap, and a blade edge of the working blade extends out of the clamping gap through the exposure opening, one of the clamping base plate and the clamping cover plate comprises at least one limiting protrusion, and the other of the clamping base plate and the clamping cover plate defines at least one limiting groove; the at least one limiting protrusion is engaged in the at least one limiting groove; and the number of the at least one limiting protrusion is at least two, and the number of the at least one limiting groove is at least two; the at least two limiting protrusions are arranged at intervals along a width direction of the clamping base plate on both sides of the clamping base plate, and the at least two limiting protrusions are engaged in the at least two limiting grooves in a one-to-one correspondence.

2. The scraper according to claim 1, wherein the clamping base plate and the connection body are integrally formed as a one-piece structure.

3. The scraper according to claim 1, wherein the clamping gap comprises a clamping section and a guiding section, a thickness of the guiding section is greater than a thickness of the clamping section;

the working blade is clamped in the clamping section by the clamping base plate and the clamping cover plate, the guiding section is configured to assist assembly and detachment of the working blade, and when the working blade is in a working position, the guiding section is located in the mounting cavity.

4. The scraper according to claim 1, wherein the clamping base plate comprises a first connection end and a first clamping face, the clamping cover plate comprises a second connection end and a second clamping face, the first connection end and the second connection end are detachably connected with each other, and the first clamping face and the second clamping face cooperatively define the clamping gap.

5. The scraper according to claim 1, wherein one of the clamping base plate and the clamping cover plate defines at least one locking hole, and the other of the clamping base plate and the clamping cover plate comprises at least one locking protrusion, the at least one locking protrusion is engaged in the at least one locking hole to fasten the clamping base plate and the clamping cover plate.

6. The scraper according to claim 5, wherein the number of the at least one locking hole is at least two, and the number of the at least one locking protrusion is at least two;

the at least two locking holes are distributed at intervals in one of the clamping base plate and the clamping cover plate, and the at least two locking protrusions are engaged in the at least two locking holes in a one-to-one correspondence.

7. The scraper according to claim 5, wherein a direction in which the at least one limiting protrusion is inserted in the at least one limiting groove is opposite to a direction in which the at least one locking protrusion is inserted in the at least one locking hole.

8. The scraper according to claim 1, wherein the button portion and the connection body are integrally formed as a one-piece structure.

9. The scraper according to claim 1, wherein the connecting member further comprises an elastic support portion, the elastic support portion and the connection body are integrally formed as a one-piece structure, and each of the elastic support portion and the button portion is arranged on a respective one of two opposite sides of the connection body;

the elastic support portion is configured to support the button portion in the guiding hole by abutting against an inner side of the housing.

10. The scraper according to claim 9, wherein the connecting member further comprises a cooperating portion, the cooperating portion and the connection body are integrally formed as a one-piece structure, the cooperating portion is arranged close to the button portion, and an inner side of the housing is arranged with a locking portion engaged with the cooperating portion;

the elastic support portion is configured to drive the locking portion to be engaged with the cooperating portion by an elastic force of the elastic support portion, and the button portion is configured to be pressed to enable the locking portion to be disengaged from the cooperating portion;

when the working blade extends out of the mounting cavity and is in a working position, the locking portion is engaged with the cooperating portion to restrict a relative position between the connection body and the housing.

11. The scraper according to claim 10, wherein the locking portion comprises a locking groove, the cooperating portion comprises a limiting boss, and the limiting boss is engageable in the locking groove;

the housing further defines a limiting recess, the limiting boss is engageable in the limiting recess, the limiting recess is formed on an inner wall of the housing, and the limiting recess and the locking groove are distributed at intervals along a sliding direction of the connection body;

the elastic support portion is configured to drive the limiting boss to be engaged in the limiting recess or the locking groove by the elastic force of the elastic support portion, and the button portion is configured to be pressed to enable the limiting boss to be disengaged from the limiting recess or the locking groove.

12. The scraper according to claim 10, wherein the elastic support portion comprises a support leg, a connection end arranged at one of two ends of the support leg, and a contact end arranged at the other of the two ends of the support leg, and the support leg is obliquely arranged on the connection body;

the connection end is connected to the connection body and is arranged close to the cooperating portion;

the contact end abuts against an inner wall of the mounting cavity away from the guiding hole to form a support;

the contact end arranged is closer to the opening than the connection end.

13. The scraper according to claim 1, wherein the housing further defines a receiving cavity for storing spare blades;

the housing defines a viewing window communicated the receiving cavity with an exterior of the housing, and the viewing window is configured for viewing a remaining amount of the spare blades in the receiving cavity.

14. The scraper according to claim 13, further comprising a cover, wherein the housing defines an access opening communicating the receiving cavity with the exterior of the housing, and the cover is configured to cover the access opening.

15. The scraper according to claim 14, wherein the cover comprises a hinge portion and an engagement portion, the hinge portion is hinged to the housing, the engagement portion is swingable about the hinge portion, and the housing defines a positioning engagement groove cooperated with the engagement portion.

16. The scraper according to claim 14, wherein the housing defines an operation notch at the access opening, and at least part of the spare blades extends out of the receiving cavity through the operation notch;

the cover comprises a protruding portion, the protruding portion defines a receiving groove, and when the cover covers the access opening, the protruding portion is embedded in the operation notch, and at least part of the spare blades is received in the receiving groove.

17. The scraper according to claim 13, further comprising at least one magnetic member, wherein the at least one magnetic member is mounted in the housing and is configured to adsorb the spare blades in the receiving cavity.

18. The scraper according to claim 17, wherein a thickness direction of the receiving cavity is the same as a thickness direction of the spare blades, and the at least one magnetic member is arranged close to a wall face of the housing in the thickness direction of the receiving cavity.

* * * * *